US007793585B2

(12) United States Patent
Rasmussen et al.

(10) Patent No.: US 7,793,585 B2
(45) Date of Patent: Sep. 14, 2010

(54) DISPOSABLE BREWING DEVICE

(75) Inventors: Ulrik Skovgaard Rasmussen, Middelfart (DK); Werner Schulz, Horsens (DK)

(73) Assignee: Columbus E. ApS (DK)

( * ) Notice: Subject to any disclaimer, the term of this patent is extended or adjusted under 35 U.S.C. 154(b) by 839 days.

(21) Appl. No.: 11/579,240

(22) PCT Filed: Apr. 13, 2005

(86) PCT No.: PCT/DK2005/000249

§ 371 (c)(1),
(2), (4) Date: Oct. 31, 2006

(87) PCT Pub. No.: WO2005/105606

PCT Pub. Date: Nov. 10, 2005

(65) Prior Publication Data

US 2007/0199453 A1 Aug. 30, 2007

(30) Foreign Application Priority Data

May 5, 2004 (WO) ..... PCT/DK2004/000310

(51) Int. Cl.
*A47J 31/00* (2006.01)
*B65D 81/00* (2006.01)

(52) U.S. Cl. ..... 99/323; 99/295; 99/317; 99/322; 426/79; 426/82; 426/433

(58) Field of Classification Search ..... 99/323, 99/295, 317, 322, 302 R; 426/77, 78, 79, 426/112, 113, 115, 433, 82
See application file for complete search history.

(56) References Cited

U.S. PATENT DOCUMENTS

| | | | | |
|---|---|---|---|---|
| 3,199,437 | A | 8/1965 | Nelsen | |
| 3,352,226 | A | 11/1967 | Nelsen | |
| 3,372,634 | A * | 3/1968 | Brinkman et al. | 99/292 |
| 4,886,674 | A | 12/1989 | Seward et al. | |
| 5,390,587 | A * | 2/1995 | Wu | 99/279 |
| 5,842,408 | A | 12/1998 | Hata | |
| 6,277,547 | B1 * | 8/2001 | Bourdelais et al. | 430/432 |
| D448,602 | S | 10/2001 | Bodum | |
| 6,622,615 | B2 * | 9/2003 | Heczko | 99/323.3 |

FOREIGN PATENT DOCUMENTS

| | | |
|---|---|---|
| DE | 609 794 | 2/1935 |
| JP | 62-10828 | 1/1987 |
| JP | 4210010 A | 7/1992 |
| JP | 7-24225 | 5/1995 |

* cited by examiner

*Primary Examiner*—Reginald L Alexander
(74) *Attorney, Agent, or Firm*—Cantor Colburn LLP

(57) ABSTRACT

The invention relates to a disposable brewing device including at least one contact volume connectable with at least one target volume, the at least one contact volume and the at least one target volume being separated by at least one filter arrangement, the at least one contact volume and the at least one target volume defining at least one predefined flow path through filter arrangement.

58 Claims, 9 Drawing Sheets

DISPOSABLE BREWING DEVICE

FIELD OF THE INVENTION

The present invention relates to a disposable package for brewing of e.g. coffee or tea.

TECHNICAL BACKGROUND AND PRIOR ART

A coffee maker such as described in USD448602S constitutes both a coffee maker and a coffee pot in one device. However, this kind of coffee maker requires cleaning after use and is not well-suited for one-time-use. The equipment is too expensive and is per se not suitable for disposal.

An example of a device for one-time-use related to the making of coffee is U.S. Pat. No. 4,886,674 disclosing a beverage making cartridge made of an air- and water-impermeable material and containing a product, which provides a beverage such as soup, chocolate or coffee when mixed in an aqueous medium. A web material is located in the sachet below the product. When using the sachet, pressurized liquid is introduced from the top of the sachet, into the sachet and through the sachet and the web material, whereby the bottom of the sachet is opened. The sachet may eventually be provided with a nozzle in the top of the sachet. A drawback of this invention is that pressurized liquid is required in order to utilize the device and dedicated equipment is needed for using it. Thus, a handheld-based brewing of coffee is not applicable.

One problem is to be able to make coffee of good and uniform quality without a machine or a coffee pot or a conventional coffee filter and funnel. This problem has at least partly been dealt with in U.S. Pat. No. 5,842,408, which describes a solution in which a package contains a filter and a foldable funnel suited for arbitrary drinking cups. The illustrated solution suffers from the drawback that it is expensive to manufacture as the foldable funnel frame forms a body separate from the outer bag, thereby complicating the manufacturing process.

One of several problems addressed by the invention is a reduction in manufacturing costs, both with respect to the manufacturing process and with respect to consumption of materials needed for the device.

Another problem addressed by the invention is to avoid necessity of specialized brewing equipment.

SUMMARY OF THE INVENTION

The invention relates to a disposable brewing device (1; 20; 1423; 1623; 1823; 2023) comprising at least one contact volume (CV; 2; 153; 173; 183; 213) connectable with at least one target volume (TV; 3; 140; 160; 180; 200; 2900; 3000; 3200), said at least one contact volume (CV; 2; 153; 173; 183; 213) and said at least one target volume (TV; 3; 140; 160; 180; 200; 2900; 3000; 3200) being separated by at least one filter arrangement (4; 144; 164; 184; 204; 2804; 2904; 3004; 3104; 3204; 3304; 3404; 3504)

said at least one contact volume (2; 153; 173; 183; 213) and said at least one target volume (3; 140; 160; 180; 200; 2900; 3000; 3200) defining at least one predefined flow path (PFP; 145; 165; 185; 205) through said filter arrangement (4; 144; 164; 184; 204; 2804; 2904; 3004; 3104; 3204; 3304; 3404; 3504).

According to the invention, the brewing device comprises a predefined flow path (PFP) ensuring that hot liquid contained in the brewing container during brewing is filtered at the latest when the hot liquid is poured out of the brewing container. Evidently, according to the invention, filtering may take place both when hot liquid is poured into the brewing device during or at the latest when the hot liquid is poured out of the disposable brewing device.

According to the provisions of the invention, a predefined flow path is mandatory in order to obtain a minimum efficient filtering compared e.g. to brewing by passive diffusion. This is in particular important when dealing with ground coffee beans of other granulated relatively solid granules, as such materials when getting into contact with liquid tends to clog.

According to the invention, the term connectable means that the brewing device is able to establish a flow from the at least one contact volume to a target volume via the at least one predefined flow path. Thus, the predefined flow path may comprise a well-defined internal flow path from the contact volume to the target volume or it may comprise a well-defined flow path defined by an interface of the device, e.g. an outlet, and an external target volume, e.g. a cup, a mug or any suitable container.

According to the invention, the term brew refers to the act of preparing by infusion in hot water.

Generally, according to a preferred embodiment of the invention, the disposable brewing device may be considered as a 'plug and play'-solution, meaning that the time for opening and using the device and the time to reach the final brewed product is rather short, the disposable brewing device being a quick and convenient high-quality solution for the consumer. The brewing time may in an embodiment of the invention be in the range of 0.5 minutes to an hour, preferably 1 to 10 minutes.

Furthermore, it may be an advantage of the disposable brewing device of the invention that all the means for brewing a hot brewed liquid are provided in one single disposable device.

In an embodiment of the invention, said at least one contact volume (153; 183) is forming a part of a brewing container (2126) within said brewing device (1423; 1823).

According to a preferred embodiment of the invention, the contact volume forms part of the brewing container of the brewing device, thereby facilitating a prolonged infusion between the liquid and the aroma material comprised in the contact volume.

In an embodiment of the invention, said at least one target volume (140; 180) is forming a part of a brewing container within said brewing device (1423; 1823).

According to a preferred embodiment of the invention, the target volume forms a part of the brewing container of the brewing device, thereby facilitating at least a partial completion of the brewing process and in particular the filtering process prior to discharge of the brewing device.

In an embodiment of the invention, at least a part of said contact volume (153; 183) and at least a part of said at least one target volume (140; 180) form a part of a brewing container within said brewing device (1423; 1823).

According to an embodiment of the invention, the contact volume and/or the target volume may be expandable. The contact volume and/or target volume may be expanded and increased e.g. as the brewing device is folded out while being filled with liquid.

In an embodiment of the invention, the brewing container (2126) is at least partly formed by joined sheets (151, 152; 191, 192) of liquid-impermeable material.

In an embodiment of the invention, said sheets of liquid-impermeable material comprise a heat-resistant polymer.

In an embodiment of the invention, said sheets of liquid-impermeable material comprise multi-layered sheets.

In an embodiment of the invention, said sheets of liquid-impermeable material comprise a laminate of at least one polymer sheet and at least one metal sheet.

In an embodiment of the invention, said sheets of liquid-impermeable material (6) comprise wall(s) and bottom (10) of said brewing container (3; 2126).

Furthermore, in an embodiment of the invention, said sheet material forms a closing arrangement, such as a closable and/or re-closable top opening.

In an embodiment of the invention, the brewing device may be manufactured with a re-closable opening, e.g. in the top, and the brewing device may be provided with aroma material and closed. Next, the closed brewing device containing aroma material may be sold, and a user may open the closing, pour liquid, e.g. water, into the brewing device, close the brewing device at the re-closable opening, cut or rip a slip of the brewing device and pour out the finished brewed product, such as coffee.

In an embodiment of the invention, said bottom of the brewing container comprises a shape-sealed fold (9, 10).

In an embodiment of the invention, said liquid-impermeable bottom material (10) is more flexible than said wall material (6).

When applying a bottom material, which is more flexible than the wall material, easy expansion of the brewing container volume is facilitated when adding hot liquid to the brewing container.

In an embodiment of the invention, said sheets of liquid impermeable material comprises at least one film or foil selected from the group of metal foils, polymer films, metallized or coated films, polymer sealants, polyesters, polyamides and polyolefines comprising polyethylenes and polypropylenes or any combination thereof.

In an embodiment of the invention, the sheets of liquid-impermeable material of the brewing container (3; 2126) have a rigidity, which is large enough to allow the brewing container to be self-standing.

In an embodiment of the invention, said liquid-impermeable material of the brewing container (3; 2126) has a thickness in the range of 10 μm to 2 mm, preferably 40 μm to 500 μm, more preferably 60 μm to 200 μm and most preferably 80 μm to 150 μm.

In an embodiment of the invention, the brewing container (2126) is at least partly formed by welded sheets (151, 152; 191, 192).

In an embodiment of the invention, said brewing container has a liquid volume of approximately 0.1 liters to 25 liters, preferably 0.2 liters to 10 liters, most preferably 0.2 liters to 1.5 liter.

According to a preferred embodiment of the invention, a liquid content comprised within the brewing device should be between 1 to about 10 cups of brewed liquid.

In an embodiment of the invention, said multi-layer structure of the brewing container material comprises an outside polymer film, an intermediate barrier layer and an inside layer of polymer sealant.

In an embodiment of the invention, said contact volume is at least partly formed by said at least one filter arrangement (4; 144; 164; 184; 204).

In an embodiment of the invention, said contact volume comprises at least one filter arrangement (4; 144; 164; 184; 204) suspended in the brewing container.

According to a preferred embodiment of the invention, the contact volume is at least partly formed by a filter arrangement welded to the brewing container, thereby forming the separation between the target volume and the contact volume within the brewing container.

In an embodiment of the invention, said filter arrangement comprises a heat resistant sheet material and wherein at least a part of said heat resistant sheet material comprises liquid permeable material.

The filter arrangement material and/or liquid-permeable inner compartment material may comprise punctured etched, melted, stamped or cut material. The material may e.g. comprise plastic, polyolefines such as polyethylene or polypropylene, polyesters, polyamides and other polymers, woven or non-woven expanded plastic, cloth, screen, wire-mesh, metal or injection-molded plastic.

In an embodiment of the invention, said heat resistant sheet material comprises a heat-resistant polymer.

In an embodiment of the invention, said liquid permeable material comprises a heat-resistant polymer sheet formed with a pattern of holes.

According to a preferred embodiment of the invention, the holes formed in the heat-resistant polymer sheet, i.e. the filter, should be predefined in position, density, size and/or shape. These predefined holes may be designed to match the applied aroma material in size, optimize through-pass of liquid to a desired flow through time, withholding of aroma material in parts of the filter, minimizing of flow-back from the target volume to the contact volume if desired, etc.

In an embodiment of the invention, the liquid-permeable material (4) is provided with a density of holes (7) in the range of 1-30 holes per $cm^2$, preferably 2-20 holes per $cm^2$ and most preferably 4-12 holes per $cm^2$.

In an embodiment of the invention, said holes (7) have dimensions in the range of 0.01 mm*0.01 mm to 2.00 mm*2.00 mm, preferably 0.1 mm*0.1 mm to 1.0 mm*1.0 mm, more preferably 0.1 mm*0.1 mm to 0.6 mm*0.6 mm.

In an embodiment of the invention, the dimension of said holes (7) is adapted to provide a brewing time of approximately 3-12 minutes under atmospheric pressure.

In an embodiment of the invention, the liquid-permeable material (4) of the filter arrangement (2) is provided with holes (7), which have been created by stamping, cutting, etching or melting.

In an embodiment of the invention, the filter arrangement (2; 144; 164) is made of a material selected from the group of polypropylene, polyethylene, polyesters, polyamides or polyolefines or other polymers.

In an embodiment of the invention, said contact volume comprises a pouch.

In an embodiment of the invention, the volume of the contact volume is regulated by the position of at least one welding (2024; 253; 263; 273) in the filter arrangement.

In an embodiment of the invention, the brewing container and the contact volume are mutually fastened by welding.

In an embodiment of the invention, said contact volume comprises a bottom fold.

According to an embodiment of the invention, the bottom fold may be a part of the filter arrangement and may be un-folded when supplying liquid into the brewing device. Furthermore, according to an embodiment of the invention, the un-folded bottom may provide a relatively large filter area and hence a large contact volume. A large filter area and contact volume may according to an embodiment of the invention offer the advantage of an effective infusion process, e.g. when brewing coffee from ground coffee. Such effective infusion process may be facilitated by a large bottom area of an un-folded filter arrangement providing a large contact volume in which substantially all of the aroma material may get in contact with the liquid. This way, the aroma material may be utilized best possible, and according to an embodiment of the invention a high utilization ratio of the aroma material may be achieved from the disposable brewing device compared to some conventional brewing equipment. Hence, the amount of aroma material may be decreased, while obtaining the same, or better, aroma quality and intensity of the brewed product. E.g., when brewing coffee, the amount of ground coffee may in a specific embodiment of the invention be lowered, e.g. by 1-3 grams pr. cup of brewed coffee. According to an embodiment of the invention, a suitable amount of aroma material, e.g. ground coffee, may be in the range of 2 to 10 grams pr. cup.

In an embodiment of the invention, said brewing device comprises at least one liquid inlet (2) to said contact volume (153; 183).

In an embodiment of the invention, said brewing device comprises a liquid outlet arrangement (2217) from said contact volume.

In an embodiment of the invention, said brewing device comprises a liquid outlet arrangement (2217) from said target volume.

In an embodiment of the invention, said outlet arrangement comprises a predefined outlet opening.

In an embodiment of the invention, said outlet arrangement comprises a removable, a cuttable, or a breakable part of the device or any combination thereof.

In an embodiment of the invention, said brewing container comprises a closing arrangement (11, 2015)

The closing arrangement may facilitate re-closing of the brewing container after liquid has been added. This closing may contribute to the insulating effect of the brewing container. The brewing container may form a kind of thermos package keeping the brewed beverage either warm or cold for a considerable period of time. The closing arrangement may further have the effect of preventing loss of beverage, for example if the brewing container accidentally falls. Moreover, the closing arrangement may contribute to protecting the user of the brewing container from getting into unwanted contact with the beverage being e.g. hot, sticky, colored, etc.

According to a preferred embodiment of the invention, the closing arrangement may comprise a re-closable, e.g. re-sealable, closing.

The closing arrangement may e.g. comprise a flap, a slide fastener, an adhesive material, etc., and combinations thereof. The closing arrangement may for example be a flap-solution comprising adhesive material or a non-flap-solution comprising a slide fastener.

In an embodiment of the invention, said closing arrangement comprises a top flap (11; 2015), a slide fastener, an adhesive material or combinations thereof.

A top flap should preferably seal the liquid within the brewing container when a part of the brewing process takes place.

In an embodiment of the invention, said closing arrangement being closable when said brewing container contains liquid.

In an embodiment of the invention, said closing arrangement comprises a peelable sealing (18).

In an embodiment of the invention, said closing arrangement comprises a film strip or a peelable strip of a hot melt type.

In an embodiment of the invention, said contact volume (153; 173; 213) comprises aroma material (5; 1524; 1724; 1824).

Aroma material may preferably comprise coffee.

In an embodiment of the invention, said aroma material comprises roast and/or ground coffee, instant coffee, tea, milk powder, herb, fruit, meat, chocolate powder, vegetables, grains, alcohol gels, encapsulated alcohol or any combination thereof or any other materials which comprises or provides flavor or aroma or other functionalities.

In an embodiment of the invention, said contact volume (153; 173; 213) comprises further additives.

Further additives may e.g. comprise sugar, milk, powdered milk, cream, powdered cream, flavoring agents, texture modifying agents, etc.

In an embodiment of the invention, said contact volume (183) comprises at least one inner compartment (183) and said inner compartment forms a brewing container (183)

said brewing container (183) being formed by a liquid-impermeable material (191, 192, 196) and provided with at least one liquid-permeable filter arrangement (184) arranged for filtering the content of the brewing container (183) when discharging hot liquid poured into the brewing container and wherein a significant part of the target volume is exterior to said brewing device.

In an embodiment of the invention, said inner compartment comprises aroma material (1824).

In an embodiment of the invention, said contact volume (153; 173; 213) comprises an inner compartment (2; 153; 173; 213), which is at least partly formed by a liquid-permeable material (4; 144; 164; 204), In an embodiment of the invention, said target volume (140; 160; 200) comprises at least one outer compartment (140; 160; 200).

In an embodiment of the invention, said at least one outer compartment forming a brewing container (140; 160; 200; 2126).

In an embodiment of the invention, said brewing container being formed by a liquid-impermeable material (6, 10; 151, 152, 156; 171, 172, 176; 211, 212, 216).

In an embodiment of the invention, said at least one liquid-permeable inner compartment (4; 144; 164; 184) being integrated within said brewing container (3).

In an embodiment of the invention, said brewing device is provided with at least one outlet duct (2025) from the target volume through an output arrangement (2217).

In an embodiment of the invention, a liquid duct should preferably form a path, which bypasses the contact volume or volumes, thereby counteracting flow back through the filter arrangement and at least flow of aroma material residues from the contact volume to the output arrangement.

In an embodiment of the invention, said brewing device comprises a substantially air-, aroma-, and liquid-impermeable outer sealing (6, 10, 18; 212; 211; 216).

In an embodiment of the invention, the disposable brewing device should be produced to include aroma material within the brewing device, preferably within the contact volume thereby facilitating an easy approach to the user as a user may simply break the outer sealing, add hot liquid to the contact volume and thereby the brewing container and finally discharge brewed liquid.

In an embodiment of the invention, said outer sealing is forming an encapsulation of aroma material prior to use.

In an embodiment of the invention, said outer sealing is forming an encapsulation of aroma material contained in the contact volume prior to use.

In an embodiment of the invention, said brewing container (3) is forming the outer sealing of the brewing device.

In an embodiment of the invention, said inner compartment comprises aroma material (1524; 1724; 1824) and is sealed by said outer compartment.

In an embodiment of the invention, the brewing container (3) and the inner compartment (2) and the outer sealing are formed from sheets, webs, rolls or lengths of structural material.

In an embodiment of the invention, said outer sealing comprises at least one polymer film, metallized or coated film, EvOH-coating, metal foil, sealant, or combinations thereof.

In an embodiment of the invention, the heat resistance of the structural material of the brewing container (3) and inner compartment material (4) is up to at least 100° C.

In an embodiment of the invention, said brewing container is equipped with at least one handle (12).

In an embodiment of the invention, said brewing container is formed as a stand-up pouch.

In an embodiment of the invention, said brewing container (3) forms at least a part of the fixation and support for the contact volume (2).

In an embodiment of the invention, said translucent or at least semi-translucent liquid-impermeable material comprises an UV-filter.

Moreover, the invention relates to a method of brewing liquid in a disposable brewing device (1), said method comprising the steps of establishing a flow of hot liquid (15) from at least one contact volume (153; 183) of the brewing device to at least one target volume (140; 180), said at least one contact volume (153; 183) and said at least one target volume (140; 180) being separated by at least one filter arrangement (144; 184), said at least one contact volume (153; 183) and said at least one target volume (140; 180) defining at least one predefined flow path (PFP) through said filter arrangement (145; 185), said at least one contact volume (153; 183) forming a part of a brewing container (2126).

In an embodiment of the invention, said at least one target volume forms part of the brewing container.

In an embodiment of the invention, said at least one predefined flow path is established within the brewing device when hot liquid is poured into the brewing device.

In an embodiment of the invention, said at least one predefined flow path is established when hot liquid is discharged from the brewing device.

In an embodiment of the invention, the method of brewing liquid is performed in a disposable device according to any of the claims 1-58

In an embodiment of the invention, the brewing is performed in said brewing container under substantially atmospheric pressure.

In an embodiment of the invention, said brewed liquid comprises coffee obtained by adding hot water into said brewing container under substantially atmospheric pressure.

Moreover, the invention relates to a use of a disposable brewing device for brewing of a beverage.

THE FIGURES

The invention will be described with reference to the drawing where

FIGS. 1A and 1B illustrate a disposable brewing device according to an embodiment of the invention, FIG. 2 illustrates a cross-section of the brewing device 1 of FIG. 1A at the line II-II, FIG. 3 illustrates a cross-section of the brewing device 1 of FIG. 1A at the line III-III, FIG. 4 illustrates a cross-section of the brewing device 1 of FIG. 1A at the line IV-IV, FIG. 5-10 illustrate a brewing process when applying the brewing device of FIG. 1A, FIG. 11 illustrates a further embodiment of the invention, FIGS. 12 and 13 illustrate a brewing process when applying the brewing device of FIG. 11, FIG. 14 illustrates an embodiment of the invention, FIG. 15 illustrates a cross-section of the above explained embodiment, FIG. 16 illustrates a further embodiment of the invention, FIG. 17 illustrates a cross-section of the above explained embodiment, FIG. 18 illustrates a further embodiment of the invention, FIG. 19 illustrates a cross-section of the above explained embodiment, FIG. 19A-19D illustrate features of the embodiments of FIGS. 14-17, FIG. 20-23B illustrate a preferred embodiment of the invention, FIG. 24A-24C illustrate three different flow-principles according different embodiments of the invention, FIG. 25-27 illustrate three further embodiments within the scope of the invention, FIG. 28-35 illustrate different filter designs of different embodiments of the invention and where FIG. 36A-36L illustrate different filter types of different embodiments of the invention.

DETAILED DESCRIPTION

For reasons of explanation, parts of the disposable brewing device illustrated in the following figures are shown as partly transparent.

FIGS. 1A and 1B illustrate a front view and a side view, respectively, of a brewing device 1 in an embodiment of the invention.

The brewing device 1 comprises an outer brewing compartment 3 also referred to as a brewing container. The illustrated brewing device is a pitcher. Sheet materials 6, a bottom welding 9, two side weldings also referred to as fusion seals 8 and an upper breakable sealing 18 collectively define the outer brewing compartment. The sheet material 6 furthermore forms a handle 12 reinforced by a continuous lamination over the complete area of the handle 12 defining areas. The upper part of the outer bag comprises a top sealing or top closing, e.g. a flap 11 formed by a sheet portion. The top closing is preferably formed with an adhesive for the purpose of closing the bag when liquid has been poured or injected into the device 1. Further explanation of the functionality of the device 1 during use in this respect will be given below. At the top of the brewing compartment 3 the sheet materials 6 are joined in an upper breakable, e.g. peelable, sealing 18, and above the sealing 18 a part of the sheet material 6 forms a clutch-flap 19. A sheet material 10, see also the FIG. 2-4, forms a lower part of the outer brewing compartment 3 and the sheet material 10 is laminated to the side welding 8 and is formed by the continuous lamination 9. The lower arrangement provides a reinforced self-standing arrangement when the outer compartment 3 has been filled with liquid. The outer compartment 3 may also be referred to as target volume elsewhere in the application.

Furthermore the brewing device comprises an inner compartment 2 defined by a filter material 4 and welded to the outer compartment 3 defining sheets 6. The inner compartment comprises an aroma material 5, illustrated in FIG. 2-4. The inner compartment may also be referred to as a contact volume elsewhere in the application, e.g. with reference to FIG. 14 to 27. In the present embodiment the inner compartment 2 is located within the brewing container 3.

Evidently, the fastening of the inner compartment 2 to the outer compartment 3 may be performed in several different ways, e.g. by welding, heat lamination, gluing, etc. and the fastening points may be discrete or continuous, e.g. one or both of the weldings 8.

The illustrated filter material 4 comprises a polymer film comprising a number of discrete holes 7 of an appropriate size obtained e.g. by stamping. The sizes of the holes may be adjusted to the desired filter function with respect to the applied aroma material 5.

In FIG. 2-4, three different cross-sections of the expanded disposable brewing device of FIG. 1A are showed at the lines II-II, III-III and IV-IV of FIG. 1A respectively.

FIG. 2 illustrates a cross-section at the line II-II of the brewing device 1. The illustrated brewing device basically comprises two compartments as described above, namely an inner compartment 2 formed by a filter material 4 located within an outer compartment 3 basically formed by the sheets 6 and 10 by the above described gathering, e.g. welding. The inner compartment 2 comprises an aroma material 5. The above-described continuous lamination 9 of the sheet material 10 to the sheets 6 forms a part of a bottom support structure, which may ensure that the brewing device is self-standing when the outer and inner compartments are filled with liquid.

Figure 1A:
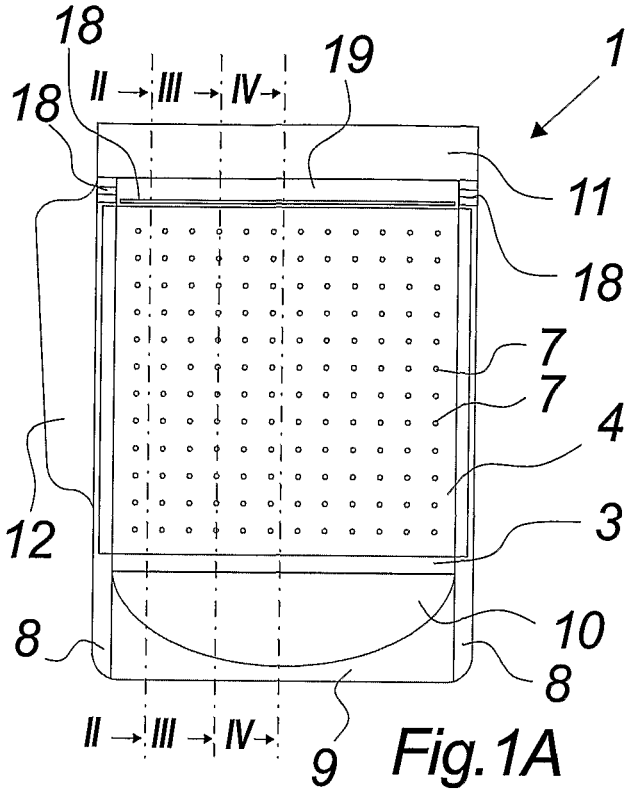
Figure 1B:
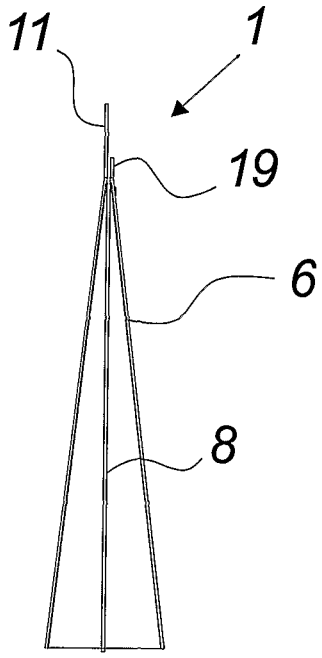
Figure 2:
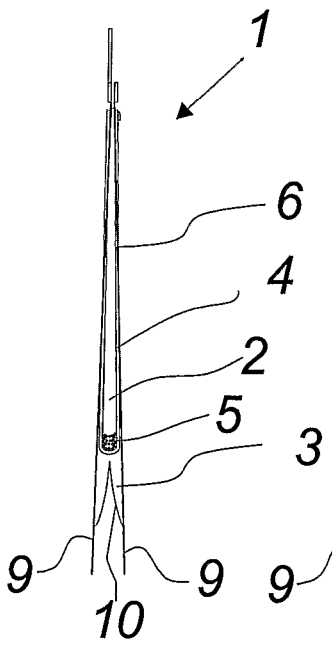
Figure 3:
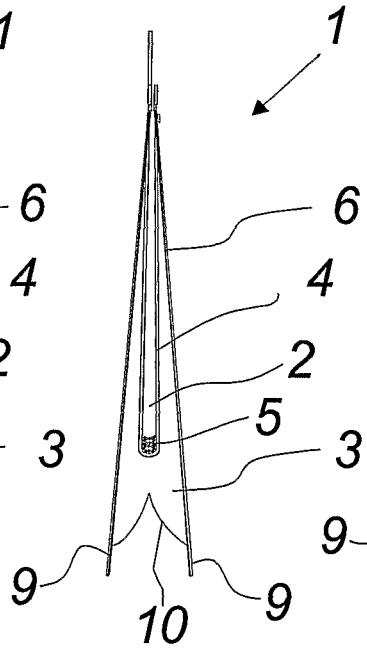
FIG. 3 illustrates a cross-section at the line III-III of the unfolded brewing device 1 of FIG. 1B and FIG. 2 at a cross-section a little closer to the line IV-IV of FIG. 1A. It is noted that the distance between the inside walls at the bottom of the outer compartment 3 is increased when compared to the cross-section of FIG. 2.
Figure 4:
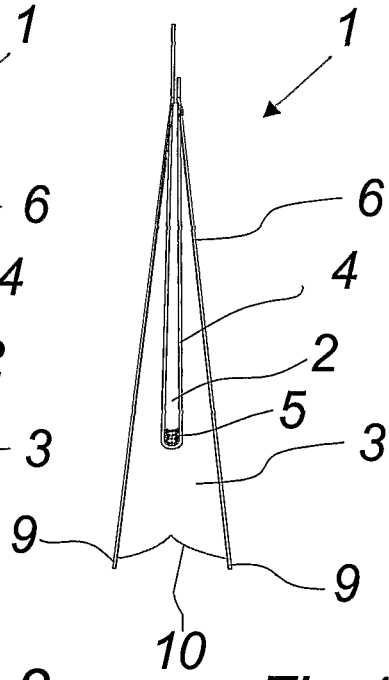
FIG. 4 illustrates a cross-section of the line IV-IV of the unfolded brewing device 1 of FIG. 1B, FIG. 2 and FIG. 3 in the midst of a the brewing device at line IV-IV. It is noted that the distance between the inside walls at the bottom of the outer compartment 3 is increased when compared to the cross-section of FIG. 3.

It is noted that according to an alternative and preferred embodiment of the invention, the sheets 6 and sheet material 10 may be formed by one single folded sheet. This sheet may comprise a lower arrangement defining welding corresponding to the gathering welding 9 of sheet 6 and 10 described above, and of course the already described side defining weldings 8.

It is furthermore noted that according to a preferred embodiment of the invention, the brewing container materials comprising sheet materials 6 and 10 combined with weldings 8 and 9 and a peelable sealing 18 in the top collectively form an outer sealing of the brewing device. This outer sealing may effectively form a barrier for gasses, moisture, aroma and other matters so that diffusion in and out of the brewing container is prevented. Thus the aroma material 5 contained in the brewing container is hereby protected until the top peelable sealing 18 is broken.

FIG. 5-10 illustrates the process of using an aroma material 5 containing brewing device as described in FIGS. 1A, 1B and 2-4. According to the illustrated embodiment the aroma material comprises ground coffee.

Figure 5:
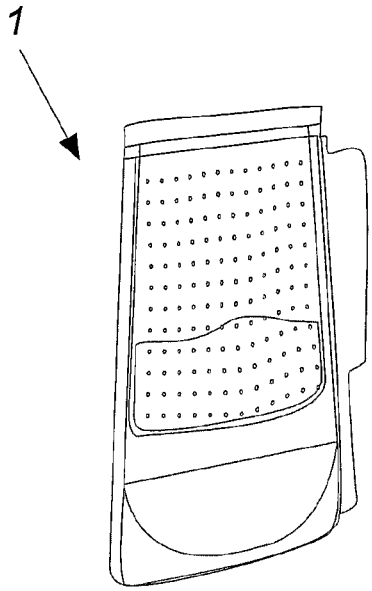

In FIG. 5, a brewing device 1 according to FIG. 1A is provided.

Figure 6:
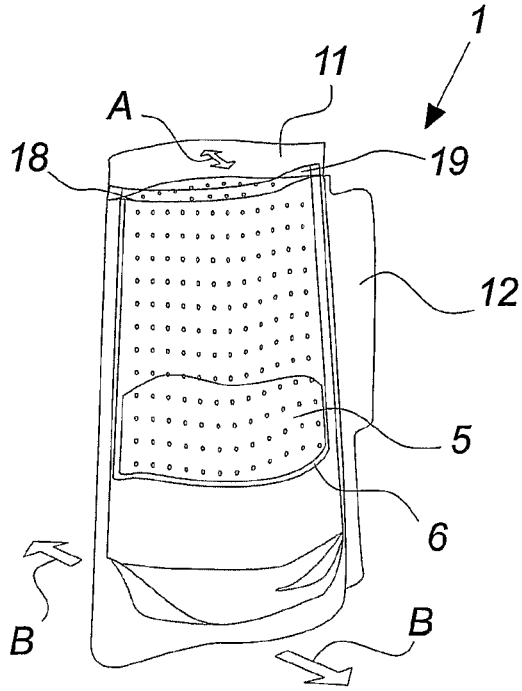

In FIG. 6, the brewing device is initially opened by mechanically stretching to the sides of the arrows A and B. Hereby the peelable sealing 18 is broken. Clutching and pulling in the flaps 11 and 19 may perform the stretching to the sides of arrow A.

Evidently, according to a further embodiment of the invention, the initial step of mechanically stretching to the sides of the arrows B may be omitted as the liquid may perform the task during filling.

Figure 7:
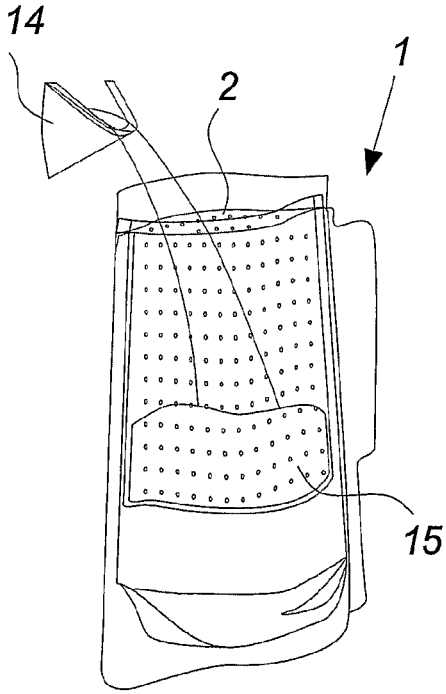

In FIG. 7, a liquid dispenser 14 such as a kettle pours liquid into the brewing device 1. The liquid, preferably hot, mixes with the ground coffee and forms a liquid coffee suspension 15 within the inner filter compartment 2.

Figure 8:
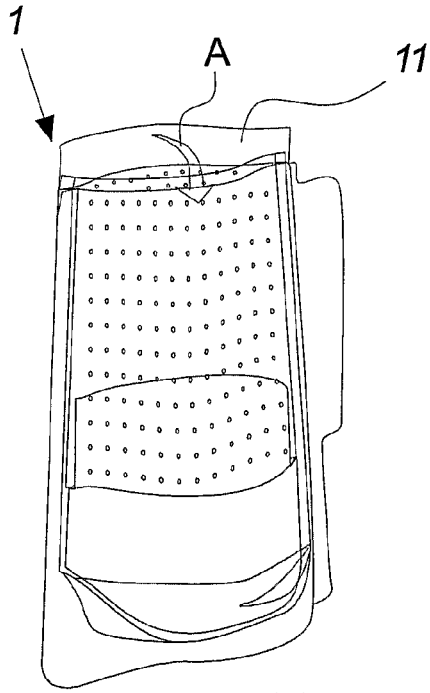

In FIG. 8, the top flap 11 is folded in the direction of the arrow A.

Figure 9:
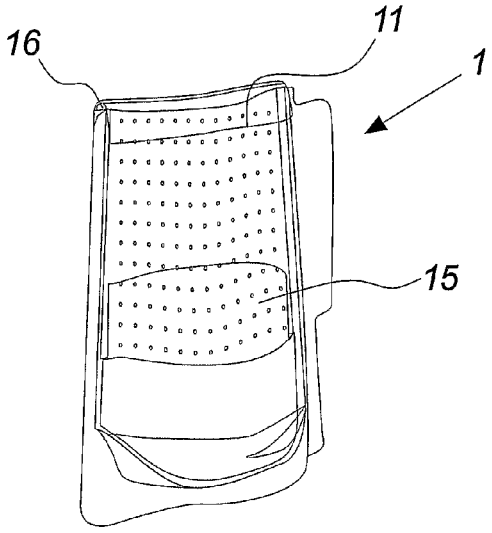

In FIG. 9, the closing of the top flap 11 has been completed and the suspension 15 is now contained within the outer compartment of the brewing device and maybe partly within the inner compartment. The closing of the top flap 11 establishes a closed container having an opening 16, which forms a kind of discharging arrangement or pour spout. Typically, the brewing device should now rest for e.g. 1-20 minutes and when brewing e.g. coffee, preferably 2-7 minutes before the brewing is completed.

Figure 10:
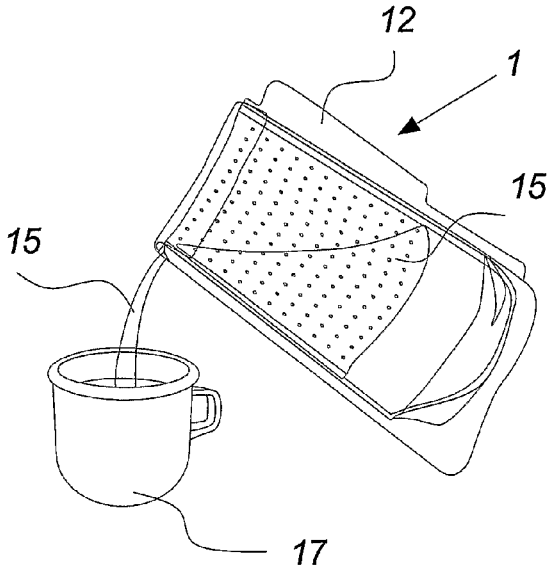

In FIG. 10, the brewing has been completed and a user may now, e.g. by means of the handle 12 lift the brewing device 1 and pour the brewed liquid coffee suspension 15 into a cup 17 and the drink is ready for intake. Note that the granules of the suspension 15 remains completely or at least substantially in the inner compartment of the brewing device 1, thereby ensuring that the obtained coffee is free of annoying substances.

Figure 11:
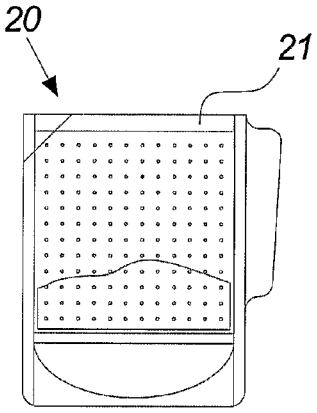

FIG. 11 illustrates an alternative embodiment 20 of the invention substantially corresponding to the illustrated embodiment of FIG. 1A, but now with a permanent upper sealing 21.

Figure 12:
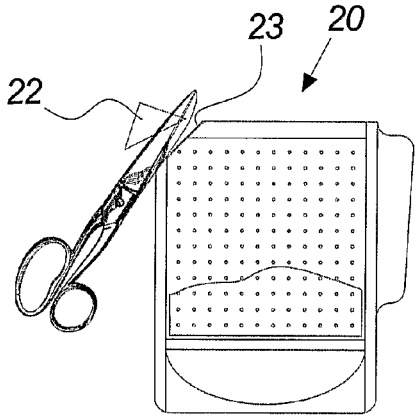

In FIG. 12, a user simply obtains access to the brewing device by cutting a slip 22 of the sealed brewing device 20, thereby forming an opening 23.

Figure 13:
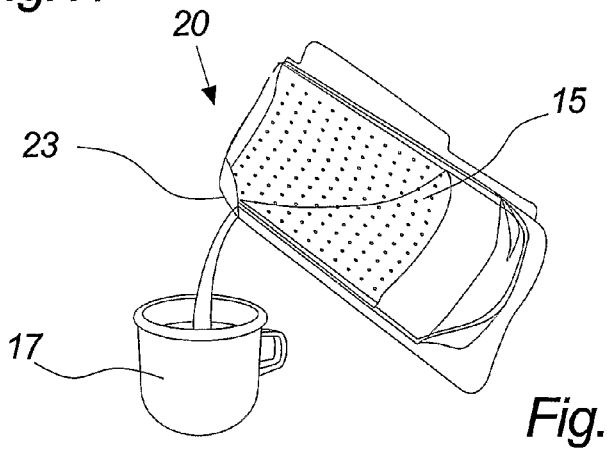

In FIG. 13, liquid, preferably water, has been injected or poured into the brewing device and the brewed liquid 15 may now be poured into e.g. a cup 17 by means of the opening 23.

Figure 14:
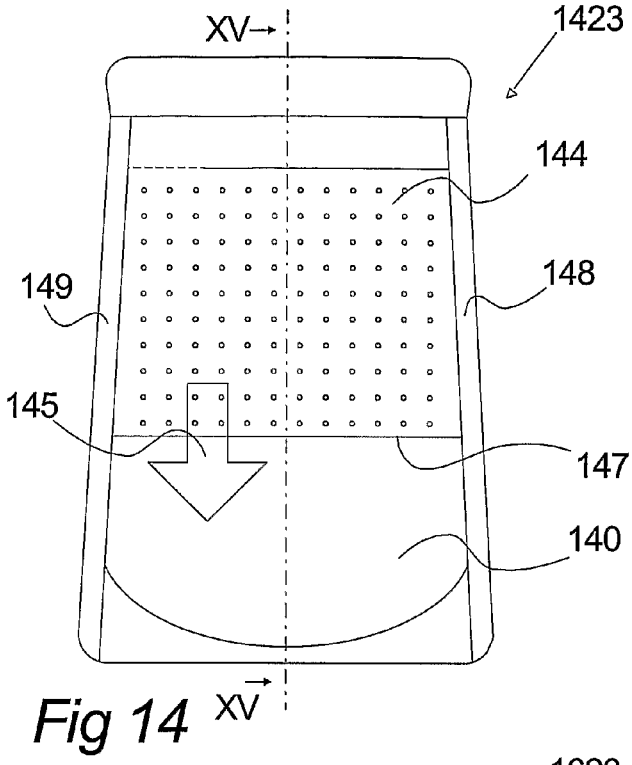
Figure 15:
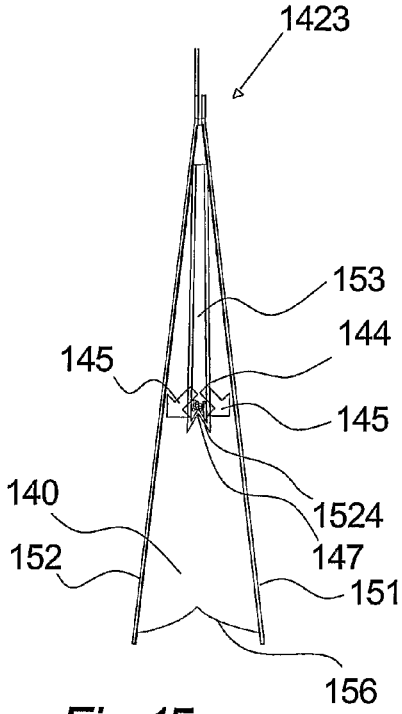

FIGS. 14 and 15 illustrate a front view and a cross-section, respectively, of a brewing device 1423 in an embodiment of the invention.

A filter sheet 144 with a filter bottom 147 comprising a fold is welded together with side weldings 148, 149 of the brewing device 1423 and defines a contact volume 153 containing aroma material 1524. A brewing process starts when hot liquid is poured into the contact volume 153 and thereby contacting the aroma material 1524. When the hot liquid gets in contact with the aroma material 1524 it obtains aroma and a substantial part of the liquid then follows a predefined flow path 145 from the contact volume 153 through the filter sheet 144 to a target volume 140. The target volume 140 is defined by two container wall sheets 151, 152 and a bottom sheet 156 of the brewing device 1423. The brewed liquid may be kept inside the target volume 140 until brewing is completed or whenever a user pours it out from the brewing device 1423.

Figure 16:
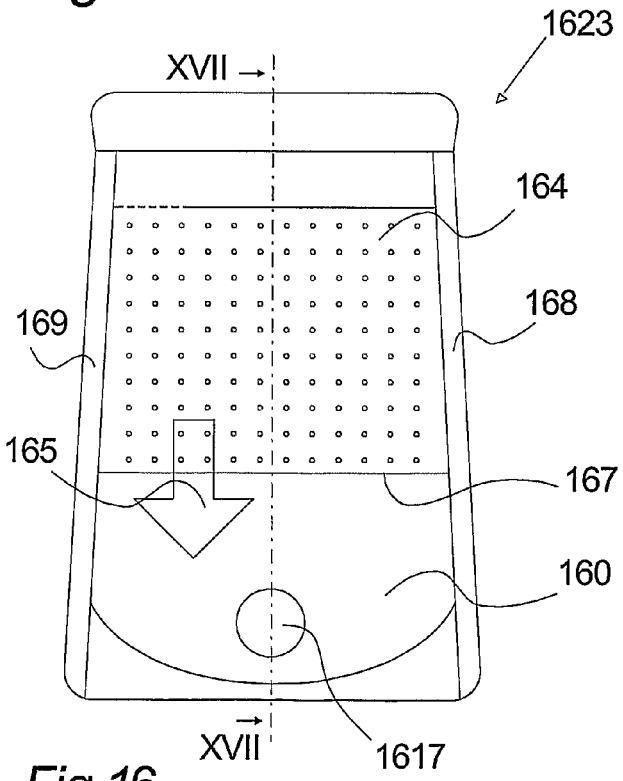
Figure 17:
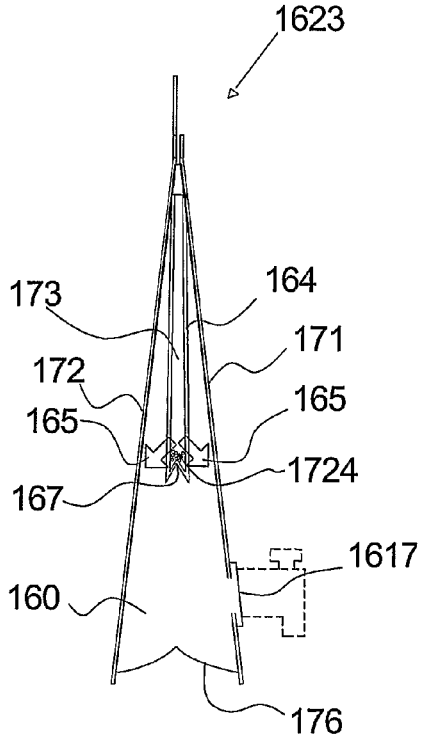

FIGS. 16 and 17 illustrate a front view and a cross-section, respectively, of a brewing device 1623 in an embodiment of the invention.

A filter sheet 164 with a filter bottom 167 is welded together with side weldings 168, 169 of the brewing device 1623 and defines a contact volume 173 containing aroma material 1724. A brewing process starts when hot liquid is poured into the contact volume 173 and thereby contacting the aroma material 1724. When the hot liquid gets in contact with the aroma material 1724 it obtains aroma and all or at least a substantial part of the liquid follows a predefined flow path 165 from the contact volume 173 through the filter sheet 164 to a target volume 160. The target volume 160 is defined by two container wall sheets 171, 172 and a bottom sheet 176 of the brewing device 1623. The brewed liquid may be kept inside the target volume 160 until brewing is completed or whenever a user pours it out from the brewing device 1623 as explained below.

An outlet opening 1617 is located in a container wall sheet 171 of the brewing device 1623. The outlet opening 1617 may be designed as a thread, which may give various possibilities for an outlet control arrangement (as indicated by dotted lines), e.g. a cork or a tap.

Figure 18:
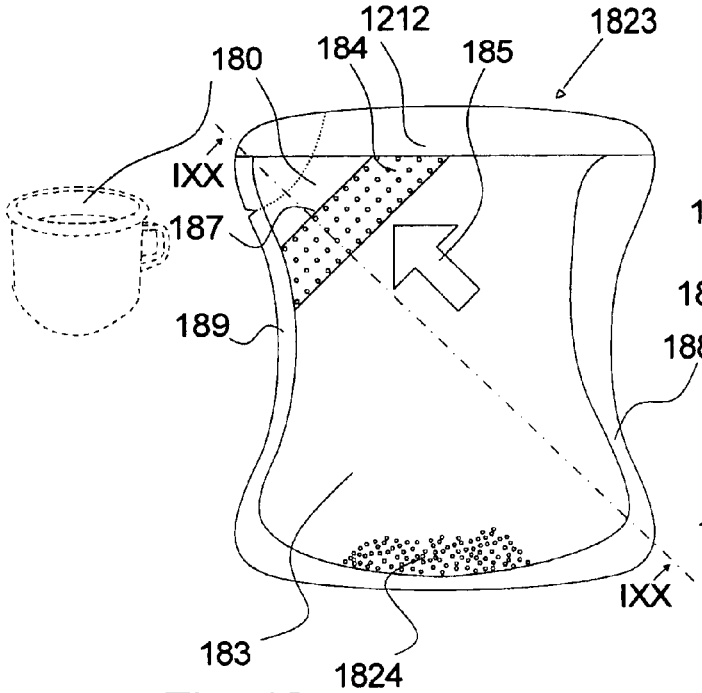
Figure 19:
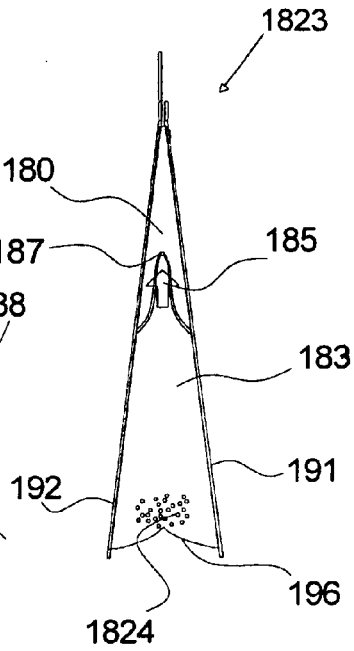

FIGS. 18 and 19 illustrate a front view and a cross-section, respectively, of a brewing device 1823 in an embodiment of the invention.

A filter sheet 184 with a filter bottom 187 is welded together with the brewing device 1823, i.e. at a side welding 189 and an upper filter welding 1212 of the brewing device 1823. The filter sheet 184 defines, together with a bottom sheet 196 and two container wall sheets, a contact volume 183 containing aroma material 1824. A brewing process starts when hot liquid is poured into the contact volume 183 and thereby contacting the aroma material 1824. In the present embodiment the contact volume forms a brewing container 183. When the hot liquid gets in contact with the aroma material 1824 it obtains aroma and the liquid then follows a predefined flow path 185 from the contact volume 183 through the filter sheet 184 to a target volume out 180. The main portion of the target volume 180 in the present embodiment is exterior to the brewing device, and may e.g. comprise the destination of the brewed liquid, e.g. a cup (not shown). The brewed liquid may be kept unfiltered inside the contact volume 183 until brewing is completed or whenever a user pours it out from the brewing device 1823.

The target volume 180 may partly appear inside the brewing device 1823 or partly, preferably mainly, outside the brewing device 1823 in form of the destination of the output, e.g. a cup.

Figures 19A, 19B, 19C, 19D:
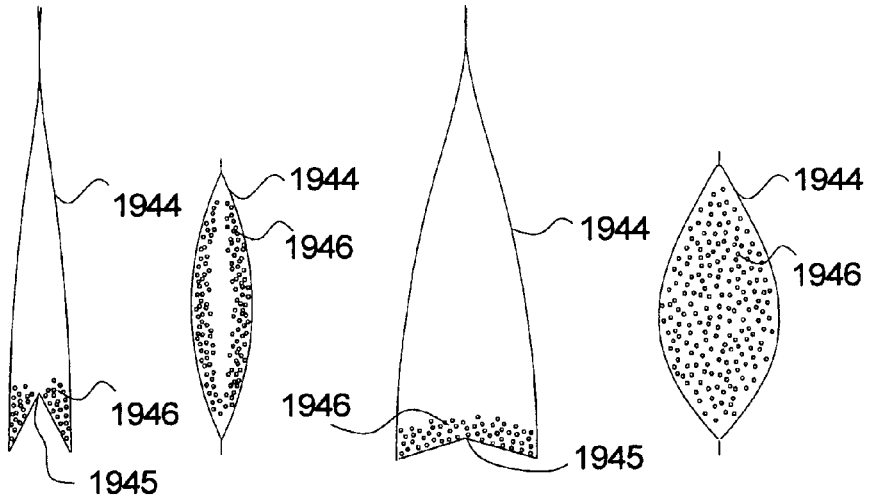

FIG. 19*a*-19*d* illustrate a filter arrangement 1944 suitable for disposable brewing devices of the present invention, e.g. the brewing devices illustrated in FIGS. 15 and 17 having filter arrangements 144 and 164, respectively. The filter arrangement is illustrated in side-view in FIGS. 19*a*-19*b* and in top- or bottom view in FIGS. 19*c*-19*d*. The filter arrangement comprises a bottom fold 1945, which is illustrated in different positions. FIGS. 19*b* and 19*d* illustrate an almost unfolded position of the filter arrangement, and as it may be recognized from the figures, the bottom area of the filter arrangement is considerably increased in the un-folded position. The filter arrangement may be opened to an unfolded position, when liquid is poured into the brewing device and filter arrangement. This may increase the contact volume and facilitate a more efficient contact, e.g. infusion process, between liquid and aroma material 1946 positioned in the filter arrangement. The size of the bottom fold may be adjusted in order to obtain a certain desired bottom area and contact volume and hence a certain quality of brewed liquid.

According to an embodiment of the invention, the construction of the filter arrangement, with regard to bottom fold construction and higher or lower position in the brewing container, may be employed in designing a certain desired contact and target volume, and hence e.g. controlling a resulting infusion process.

FIG. 20-23B illustrate a front view and a cross-section, respectively, of a brewing device 2023 in an embodiment of the invention comprising a brewing container 2126.

The brewing device 2023 is defined by two container wall sheets 211, 212 and a bottom sheet 216. The two container wall sheets 211, 212 are mutually attached at the top of the device by means of an upper breakable and re-sealable sealing 2011, by side weldings 208, 209. In the bottom of the device 2023 the two container wall sheets 211, 212 are joined by means of the bottom sheet 216 by means of bottom weldings 2010. A top flap 2015 is located on top of the brewing device 2023 serving several different purposes such as handling during use or sealing during brewing when hot liquid has been poured into the device 2023.

A brewing process starts by breaking the upper breakable sealing 2011 and pouring hot liquid into a contact volume 213 containing aroma material 2124. The contact volume is defined by a filter sheet 204 with a filter bottom 207. The contact volume 213 is suspended in the brewing device 2023 to the two container wall sheets 211, 212 in upper filter welding 2012 and side weldings 208, 209 of the brewing device 2023. The upper filter weldings 2012 in the illustrated embodiment are only running a part of the complete transverse direction thereby leaving a part of the filter sheet unattached to the two container wall sheets 211, 212 and thereby forming a filter opening 2013 as indicated by the dotted line. During brewing, the contact volume should preferably be closed by means of a closing arrangement in the form of a top flap 2015. The closing arrangement may e.g. comprise an adhesive or any suitable means for obtaining a reliable sealing during brewing.

When hot liquid gets in contact with the aroma material 2124 it obtains aroma and a substantial part of the liquid then follows a predefined flow path 205 through holes 2014 in the filter material 204 to a target volume 200. The target volume 200 is defined by two container wall sheets 211, 212, a bottom sheet 216 and the upper filter welding 2012.

Figure 22:
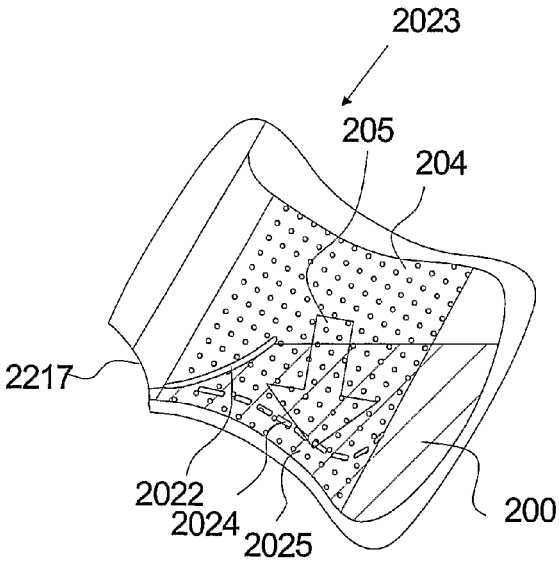

During the brewing process an outlet opening 2217, illustrated in FIG. 22 of the same device, is closed by a slip 2016 at a perforated line 2018. To enable the brewed liquid to leave the outlet opening 2217 the slip 2016 has to be removed as illustrated in FIG. 22. To lighten the removing of the slip 2016 a notch 2020 is made in the side welding 209 where the perforated line 2018 is formed e.g. 2 cm from the top of the brewing device 2023 to the top flap 2015 of the brewing device 2023, e.g. 2 cm from the side welding 209.

When the slip 2016 is removed as illustrated in FIG. 22, the brewed liquid may flow mainly or at least partly through the filter opening 2013 and out of the target volume 200 and into e.g. a cup (not illustrated) when tilting the device 2023. Evidently, some of the brewed liquid may flow back through the filter. To prevent or minimize the aroma materials 2124 from leaving the contact volume 213 when the brewed liquid is poured out of the target volume 200 a barrier welding 2022 is welded in the filter sheet 204.

Moreover, the illustrated device 2023 is formed with welding pattern 2024 forming an outlet duct 2025. The outlet duct forms part of the target volume 200. When tilting the brewing device 2023 as illustrated in FIG. 22, brewed liquid may pass via the outlet duct 2025 without passing through the filter 204 again. In this way, emptying of the device is made easier, as the duct 2025 serves as a bypass with respect to the filter 204, thereby reducing the risk of clogging through the filter 204.

Figure 20:
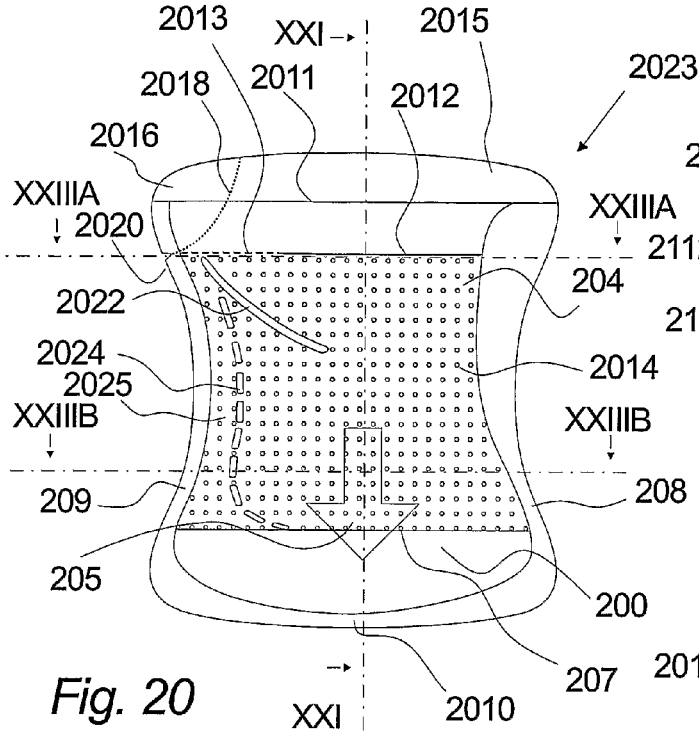
Figure 21:
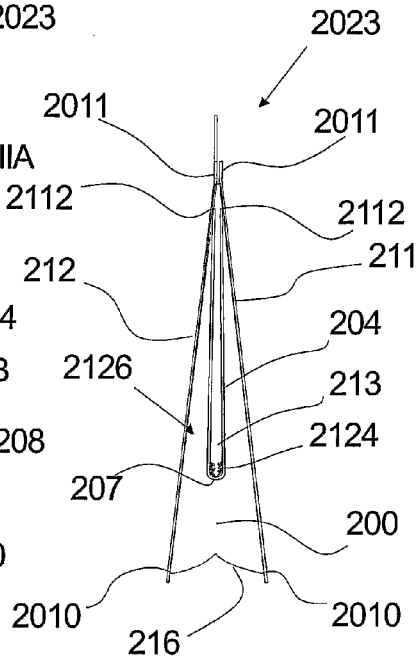
Figure 23A:
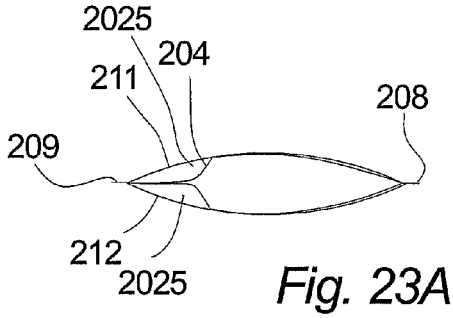

FIG. 23*a* shows a cross-section along the line XXIIIA illustrated in FIG. 20 in the near vicinity of where the filter 204 is fastened to the sheets 211, 212. The illustration shows how the upper filter welding 2012 of the filter 204 results in that the sheets 211, 212 form the outlet duct 2025 from the target volume 200 to the outlet of the device. Note that the filter materiel 204 divides the outlet duct 2025 physically in two volumes, but also that liquid may flow between the two volumes as the separating material is liquid permeable.

Figure 23B:
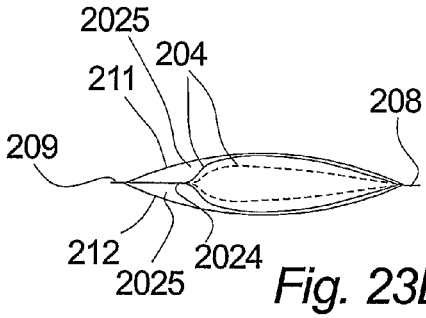

FIG. 23*b* shows a cross-section along the line XXIIIB illustrated in FIG. 20 in the vicinity of the filter bottom 207.

The illustration shows the principle nature of outlet duct 2025 in the lower part of the device.

The illustration shows how the welding pattern 2024 both results in that the effective circumference of the inner compartment formed by the filter sheet 204 is less than the effective circumference of the outer compartment formed by the sheets 211, 212, thereby reducing the risk of sticking between the two compartments when pouring water into the target volume. Thus, this provision optimizes the possibility of obtaining a flow via the predefined flow path 205 from the contact volume 213 to the target volume 200 when pouring liquid into the brewing device.

Note that the dotted line, designated 204, merely illustrates another position of the filter sheet 204. Different positions of the filter sheet 204 may thus appear depending on e.g. liquid content in the device or e.g. depending on the inclination of the device relative to the outlet opening 2217.

Figure 24A:
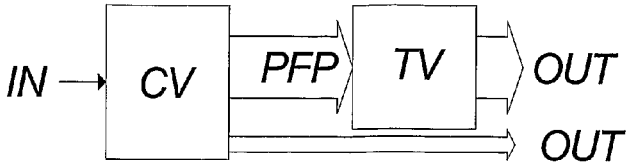
Figure 24B:
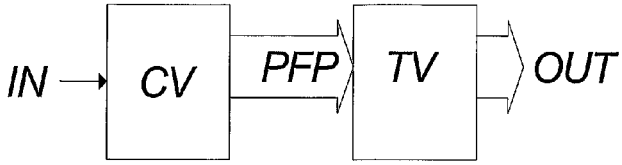
Figure 24C:
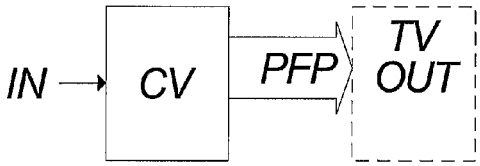

FIG. 24*a*-24*c* illustrate three different flow principles according to different embodiments of the invention, where FIG. 24*a* corresponds to the brewing device illustrated in FIG. 14 and FIG. 15, FIG. 24*b* corresponds to the brewing device illustrated in FIG. 16 and FIG. 17 and where FIG. 24*c* corresponds to the brewing device illustrated in FIG. 18 and FIG. 19.

Thus, FIG. 24*a* illustrates the main flow principle of how brewing and filtering of liquid are performed in the embodiment of FIGS. 14 and 15.

Hot liquid initially forms an input IN. The input IN is poured into the contact volume CV, i.e. the contact volume 153 of FIG. 15. A substantial part of the input IN then flows from the contact volume CV into the target volume TV, i.e. the target volume 140 of FIGS. 14 and 15 via a predetermined flow path PFP, corresponding to the flow path 145 illustrated in FIG. 14 and FIG. 15. A filtering is obtained simultaneously with the transfer of liquid from the contact volume CV to the target volume TV.

When brewing is completed, the brewed liquid is poured out of the target volume TV, thereby forming a substantial part of the output OUT. As it may appear from FIG. 14 and FIG. 15 some of the input may remain in the contact volume and thereby bypassing the target volume TV.

Provisions to minimize the flow directly from the contact volume CV to the output OUT are illustrated in FIG. 20-22 and FIG. 25-27 in variants of the embodiment illustrated in FIG. 14 and FIG. 15. The illustrated provisions primarily comprise welding applied for the purpose of maximizing the flow through the predetermined flow path PFP of the devices.

FIG. 24*b* illustrates the main flow principle of how brewing and filtering of liquid is performed in the embodiment of FIGS. 16 and 17.

Hot liquid initially forms an input IN. The input IN is poured into the contact volume CV, i.e. the contact volume 173 of FIG. 17. Most of the input IN then flows from the contact volume CV into the target volume TV, i.e. the target volume 160 of FIGS. 16 and 17 via a predetermined flow path PFP, corresponding to the flow path 165 illustrated in FIG. 16 and FIG. 17. A filtering is obtained simultaneously with the transfer of liquid from the contact volume CV to the target volume TV.

When brewing is completed, the brewed liquid is poured out of the target volume TV by means the outlet opening 1617 it is thereby ensured that all or at least the major part of the input will result in an output OUT, which has passed from the contact volume CV to the target volume via the predefined flow path PFP.

FIG. 24*c* illustrates the main flow principle of how brewing and filtering of a liquid is performed in the embodiment of FIGS. 18 and 19.

Hot liquid initially forms an input IN. The input IN is poured into the contact volume CV, i.e. the contact volume 183 of FIG. 19. In other words, according to the illustrated embodiment of the invention, brewing is performed primarily in the contact volume, and the filtering is performed just immediately before the device is emptied.

Thus, most of the input IN flows from the contact volume CV into or via the target volume TV, i.e. via the target volume 180 of FIGS. 18 and 19 via a predetermined flow path PFP, corresponding to the flow path 185 illustrated in FIG. 18 and FIG. 19. A filtering is obtained simultaneously with the transfer of liquid from the contact volume CV to the target volume TV.

In other words, only a minor part of the target volume TV is found within the device and the output OUT may be regarded to be comprised in a complete target volume TV exterior to the device, e.g. a cup.

Figure 25:
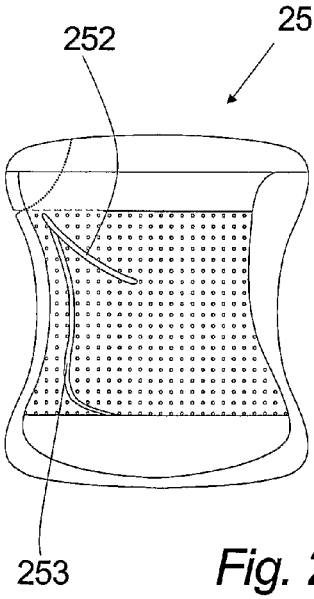
Figure 26:
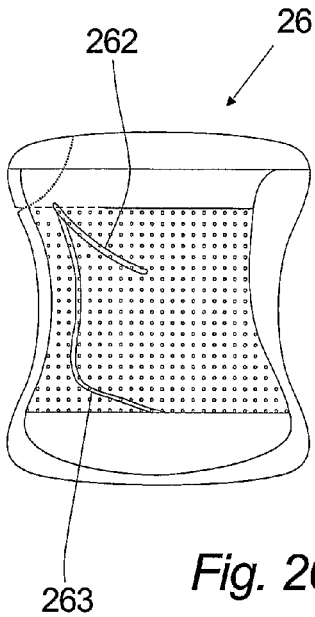
Figure 27:
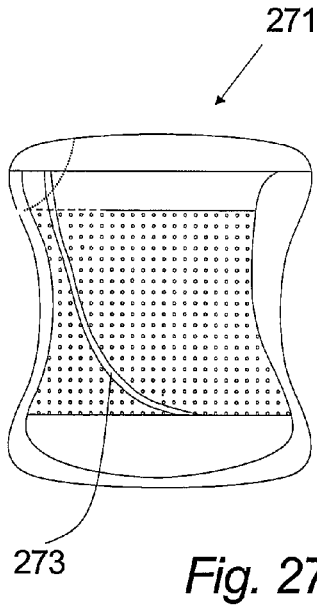

FIG. 25-27 illustrates different embodiments within the scope of the invention.

Basically, the illustrated embodiments of brewing devices 251, 261 and 271 concern reductions of undesired output from the contact volume of the device and/or evidently to increase the flow through the predetermined flow path of the individual bag.

FIG. 25 illustrates a brewing device 251 formed with a welding 253 adapted for formation of an outlet duct as earlier described in the embodiment illustrated in FIG. 20-23. In this embodiment the welding is continuous. As mentioned, a by-pass to the contact volume of the device is obtained, when the target volume is emptied.

Moreover, the device 251 is provided with a welding 252 adapted for preventing flow of aroma material to the outlet of the device during emptying. Moreover, the welding 252 functions as barrier intended for the purpose of forcing liquid from the contact volume of the device into the target volume or the outlet duct, thereby resulting in a maximized liquid flow via the predetermined flow path of the device.

FIG. 26 illustrates a further variant of a brewing device 261 of the invention also formed with a welding 263 adapted for formation of an outlet duct as earlier described in the embodiment illustrated in FIG. 20-23. In this embodiment the welding is continuous. As mentioned, a by-pass to the contact volume of the device is obtained when the target volume is emptied.

Moreover, the device 261 is provided with a welding 262 adapted for preventing flow of aroma material to the outlet of the device during emptying. Moreover, the welding 262 functions as barrier intended for the purpose of forcing liquid from the contact volume of the device into the target volume or the outlet duct, thereby resulting in a maximized liquid flow via the predetermined flow path of the device.

Basically, the embodiment of FIG. 26 corresponds to the embodiment of FIG. 25, but now with an enlarged outlet duct.

FIG. 27 illustrates a further variant of a brewing device 271 of the invention also formed with a welding 273 adapted for formation of an outlet duct as earlier described in the embodiment illustrated in FIG. 20-23. In this embodiment, the welding is continuous. As mentioned, a by-pass to the contact volume of the device is obtained when the target volume is emptied. Compared to the embodiment of FIG. 26, the welding 273 is now stretching in the complete length of the filter and to the top of the combined contact and target volume, thereby separating the contact volume and target volume completely, thereby ensuring that all liquid transport from the contact volume to the target volume is performed via the filter, thereby rendering the backflow barriers 252, 262 of the previous embodiments superfluous.

According to the invention, the applicable possibilities for location and design of the filter arrangement inside the brewing device are various.

Likewise according to the invention, the applicable possibilities for location and number of holes in the filter arrangement are various.

The filter design and density of holes greatly influence the brewing process. Thus, the brewing time, the strength of the brewed beverage, e.g. coffee, may be controlled and adjusted by design of the filter arrangement. Principles in changing the filter arrangement, including the hole density, are illustrated in the following FIGS. 28 to 36.

FIGS. 28-35 illustrate a series of different embodiments of brewing devices 2823, 2923, 3023, 3123, 3223, 3323, 3423, 3523 wherein different designs and locations of the filter arrangement and different numbers of holes in the filter arrangement are exemplified. It should be noted, that the figures are only meant to show the principles, which means that not all details in the brewing devices are displayed. Moreover, the figures are front views, meaning that the indicated filters appear as single filter sheets, but actually they are filter arrangements corresponding to those showed e.g. in FIG. 21 as 204 and 207 and also with filter bottoms diverging from 207 in FIG. 21. The filter bottom may be suitable in the form of diverse folded and/or welded designs.

Figure 28:
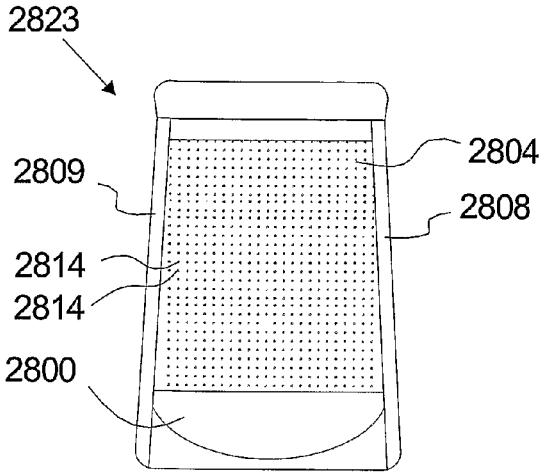

FIG. 28 illustrates an embodiment of the invention, where the filter sheet 2804 is welded together with the side weldings 2808, 2809 of the brewing device 2823 in the entire length of the filter sheet 2804 leaving a relatively small target volume 2800 for the brewed liquid. If the volume of the hot liquid poured into the brewing device 2823 is greater then the target volume 2800, a part of the brewed liquid will stay in contact with the aroma material until a quantity of the brewed liquid is poured out of the target volume 2800 resulting in increased strength of the brewed liquid during time.

Figure 29:
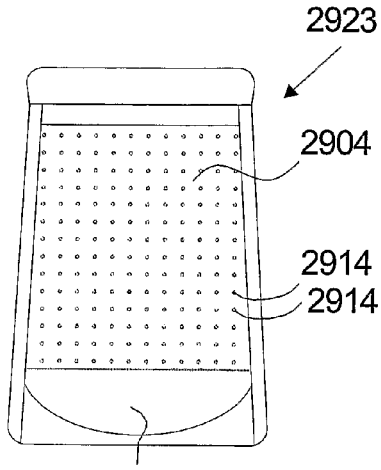

FIG. 29 illustrates a further embodiment of the invention. The difference compared to FIG. 28 is the size and density of the holes 2914 compared to 2814. The filter sheet 2904 of FIG. 29 compared to filter sheet 2804 of FIG. 28 leads to a faster flow velocity and thereby a shorter contacting time between hot liquid and aroma material, thus leading to at milder taste of the brewed liquid.

Figure 30:
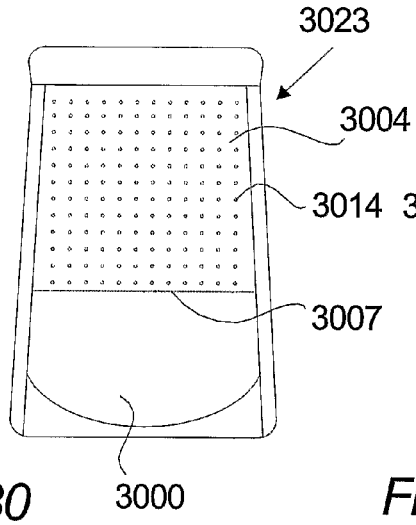

FIG. 30 illustrates a further embodiment of the invention, where the filter bottom 3007 of the filter sheet 3004 comprising holes 3014 leaves a target volume 3000 enabling the brewing device 3023 to contain a larger quantity of brewed liquid compared to the brewing devices in FIGS. 28 and 29 with smaller target volumes 2800 and 2900.

Generally, the design of the filter arrangement, including the position being high or low in the brewing container, leaving a large or small target volume, may easily be regulated in the manufacturing of the disposable brewing device. According to the invention, this filter arrangement designing may be used to control the brewing process performed by a disposable brewing device of the invention.

E.g. according to an embodiment of the invention, when the filter arrangement is positioned high in brewing device, less or none of the brewed liquid gets in contact with the aroma material in the contact volume and/or filter arrangement. Hence, the brewing process is stopped immediately after passing through the filter arrangement and/or reaching the target volume. On the other hand, when the filter arrangement is positioned low in the brewing device, some or a lot of the brewed liquid may stay in contact with the aroma material, thereby getting more aromatic through time, thus, the brewing process is not ended, even after the liquid has passed through the filter arrangement.

In an embodiment of the invention, the disposable brewing device is designed in such a way that some of the brewed liquid in the target volume in the brewing container may also be in contact with the aroma material, until the first portions, e.g. a few deciliters, of the brewed liquid has been poured out of the brewing container.

Furthermore, a filter arrangement positioned low in the brewing device may increase the self-supporting abilities of the brewing device according to the invention, while a filter arrangement positioned high may have the opposite constructional consequence.

Figure 31:
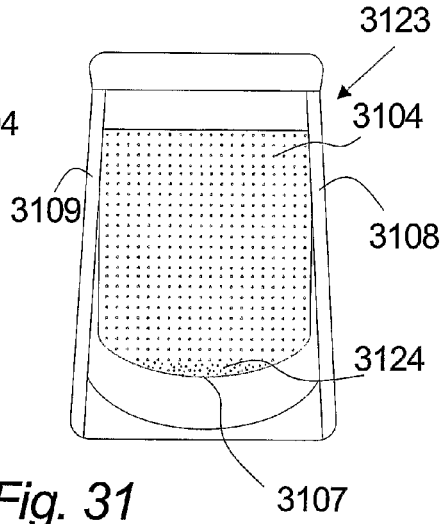

FIG. 31 illustrates a further embodiment of the invention. The filter sheet 3104 is herein only welded together by side weldings 3108, 3109 of the brewing device 3123 at the upper part of the filter sheet 3104. Furthermore, the filter bottom 3107 has been descended, which may cause aroma material 3124 to gather in the middle of the filter bottom 3107 and thereby ensure a high exploit of the aroma material.

Figure 32:
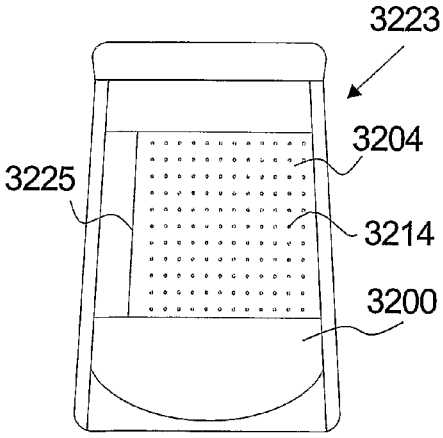

FIG. 32 illustrates a further embodiment of the invention, where the filter sheet 3204 has a barrier welding 3225 in the filter sheet 3204 leaving the area of the filter sheet 3204, containing holes 3214, small. This filter design may serve to prevent the filter sheet 3204 from getting in contact with or stick to the container wall sheets. Thus, a hindering of the brewed liquid in entering the target volume 3200, that such a contact might have caused, may be prevented by the illustrated design of the filter arrangement.

Figure 33:
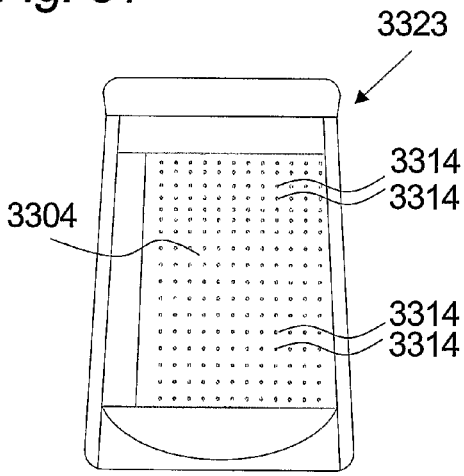

FIG. 33 illustrates an embodiment corresponding to FIG. 32, but with the difference that the filter arrangement/filter sheet 3304 is longer than the corresponding filter 3204 in FIG. 32. Thus, it is shown that the filter arrangement may be implemented in various lengths. Furthermore, in FIG. 33, it is illustrated that the density of holes 3314 is different in different areas of the filter sheet 3304. Thus, it is shown that the hole density does not have to be the same over the complete area of a filter sheet. The same applies for the hole size, which may likewise be varying over the area of the filter sheet. Different hole densities and sizes in the same filter sheet may be employed in order to obtain a certain desired brewing time and quality of the brewed product.

Figure 34:
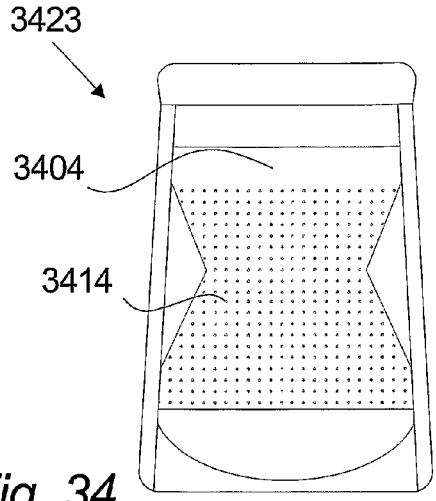

FIG. 34 illustrates a further embodiment, in which the filter sheet 3404 is changing in width over the sheet area. In FIG. 34, the filter sheet shape resembles of an hourglass, but various further shapes may be applicable. The filter sheet shape shown in FIG. 34 may allow the user of the brewing device 3423 to be able to easily recognize a liquid level when looking into the brewing device from above while pouring liquid in. As seen from above, the surface of the liquid is smallest, when the liquid level reaches the most narrow area of the filter arrangement/filter sheet 3404. Furthermore, FIG. 34 illustrates that a part of the filter sheet has no holes 3414 (perforations), meaning that in FIG. 34 filtering, i.e. flow through the filter arrangement is restricted to the lower area of the filter arrangement. Hereby it may for example be avoided that liquid flows through the filter arrangement without getting in contact with aroma material positioned in the lower area of the filter arrangement.

Figure 35:
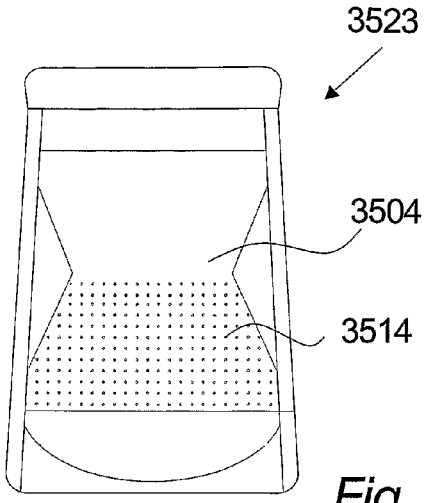
Figure 36A:
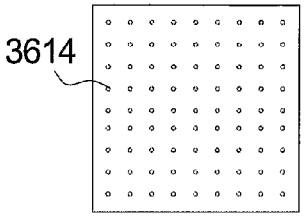
Figure 36B:
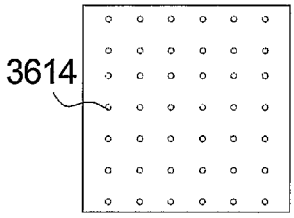
Figure 36C:
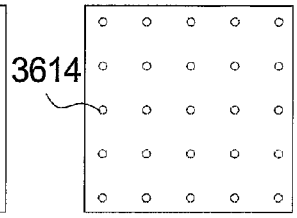
Figure 36D:
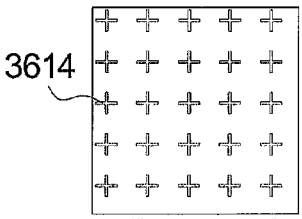
Figure 36E:
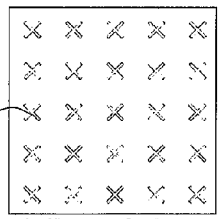
Figure 36F:
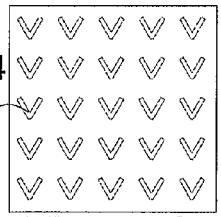
Figure 36G:
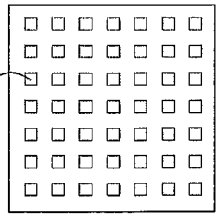
Figure 36H:
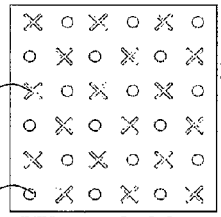
Figure 36I:
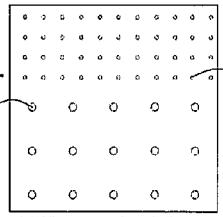
Figure 36J:
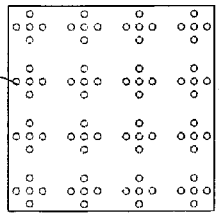
Figure 36K:
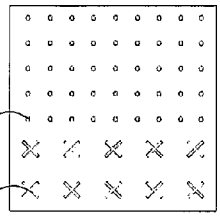
Figure 36L:
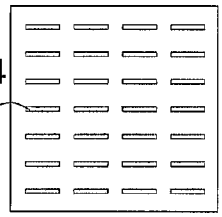

FIG. 35 illustrates a variation of the shaped filter arrangement in FIG. 34. In FIG. 35, holes 3514 in the filter sheet 3504 are only provided in the lower half area of the filter arrangement. Thereby it is obtained that liquid may only flow through the filter arrangement at the narrowest part and below, thus it may for example be obtained that all liquid flowing through the filter arrangement actually gets in contact with aroma material laying in the lower part of the filter arrangement.

FIG. 36A to FIG. 36L illustrates various sizes and shapes of holes 3614 in the filter sheets employed in various brewing devices according to the present invention. The size, shape, density, location, etc. may be applied to obtain desired flow properties, adaptation of the filter sheets to the properties of the relevant aroma material, control of foaming resulting from the contact between the aroma material and the liquid, etc.

General construction principles, material choices, to all the above-described embodiments will be given below in order to avoid superfluous repetitive explanations to all or several figures.

Preferred choice of materials for the purpose of making a brewing device according to the embodiments of FIG. 1-27 is outlined below.

Wall sheets 6, 151, 152, 171, 172, 191, 192, 211, 212 of the brewing container may for example comprise a multi-layer laminate material comprising three layers: An outside layer made of PETP, an intermediate layer as barrier layer made of aluminum foil, e.g. a 9 μm foil and an inside layer forming a sealant comprising 150 μm high-density polyethylene (HDPE). The multi-layer laminate material may typically comprise two or further layers.

The bottom sheet 10, 156, 176, 196, 216 of the brewing container may for example be made of a multi-layer laminate material comprising three layers: An outside layer made of coextruded biaxially oriented polypropylene, e.g. of a thickness of 20 μm, an intermediate layer as barrier layer made of polyethylene terephthalate (PET) metallized and coated with ethylene vinyl alcohol (EvOH), and an inside layer forming a sealant comprising, e.g. a 50 μm linear low-density polyethylene (LLDPE) or high-density polyethylene (HDPE).

Filter material 4, 144, 164, 184, 204, 2804; 3504 and/or inner compartment may for example be made of 30 μm high-density polyethylene (HDPE) stamped with holes of 0.2*0.4 size and 8 holes per $cm^2$ density.

Referring to all of the above-described figures and further embodiments as well, some generally applying features of a brewing device in accordance with several embodiments of the invention are presented in the following.

Generally, it is noted that the inner compartment(s) described with reference to FIG. 1-13 conceptually corresponds the so-called contact volume(s) of FIG. 14-27 and that the outer compartment(s) FIG. 1-13 corresponds to the target volume of FIG. 14-27.

Generally, a user of the brewing device may find that the brewing device is initially ready for use and typically no equipment is needed to support it during use, as well as no special equipment is usually needed for the brewing device to function. Moreover, atmospheric pressure may typically be sufficient and desired for using the brewing device, that is, no pressure besides the atmospheric pressure and the pressure exerted by the liquid itself is needed in order to make liquid, such as water, pass through the filter material.

According to the present invention, a disposable device is intended for one or a few times of use.

The inner compartment and/or filter arrangement, the brewing container, the outer sealing, the contact volume and the target volume may be formed as bags or pouches, and the brewing device may before use appear as a flat package, taking up only a small amount of space.

The brewing device may be provided as a sealed package containing aroma material. This is typically an advantage, as the user may then be able to brew a beverage just by supplying a certain liquid.

In an alternative embodiment, it may be an advantage for the user of the brewing device to provide the aroma material at the time of use, and in such case the brewing device may be provided without aroma material, entailing that there is no need for a sealing of the brewing device, given that there is no aroma material to protect during transport and storage.

When the brewing device is used for brewing of coffee, the brewing process may involve that ground coffee is mixed with water, causing an infusion process during which the ground coffee and water may interact, which may include that the ground coffee gives aroma to the water and thereby bringing about a coffee beverage.

The disposable brewing device according to the invention may generally be used to prepare different hot beverages such as coffee, espresso, latte, mocha, tea, hot chocolate, etc. Thus, some suitable liquids to apply may be water, milk, etc, and the aroma material may comprise roast and/or ground coffee, instant coffee, tea, milk powder, herb, fruit, chocolate powder, vegetables, grains or any combination thereof or any other materials which comprises or provides flavor or aroma or other functionalities.

Other functionalities than flavor or aroma may for example be color, consistency, energy, etc.

The invention is in particular suitable for brewing on the basis of aroma material requiring active infusion due to the structure of the aroma material. Such an aroma material may e.g. comprise coffee as coffee granules are typically clogged when mixed passively with liquid unless a significant volume is applied as a brewing container, thereby counteracting the desired interaction between the aroma material and the hot liquid.

The brewing container 3, the inner compartment 2 and/or filter arrangement 4, contact volumes, target volumes and/or the outer sealing may be formed from sheets, webs, rolls or lengths of structural material.

Generally forming all parts of the brewing device out of e.g. webs of structural material contributes to a simple and cost-saving manufacturing process.

The brewing container, the inner compartment, contact volumes, target volumes and/or the filter arrangement may each be formed out of one single sheet of structural material. Alternatively, they may be formed from two, three or more sheets of material that are assembled to form the brewing container and/or the inner compartment or filter arrangement.

The structural material of the outer compartment and/or brewing container and/or outer sealing may be a film material.

A film material according to the invention may comprise a single or a multi-layer structure. The layers may be laminated, mutually welded, or generally gathered.

A laminate composition of the structural material may facilitate a material, which is light, tight and stabile during manufacturing, storage and handling of the brewing device.

The structural material of the outer compartment and/or brewing container and/or outer sealing may be coated with a protective film and/or a barrier layer. In case the structural material itself is not light-tight, it is preferred to coat it in order to protect the aroma material contained.

When the brewing device is packed with aroma material such as ground coffee beans having a tendency to loose aroma when exposed to the surroundings, it is of crucial importance that the barrier layer is tight, especially when the amount of aroma material is relatively small compared to larger coffee packages.

The structural material of the outer compartment and/or brewing container and/or outer sealing may comprise at least one polymer film, metallized or coated film, EvOH-coating, metal foil, sealant or combinations thereof.

The multi-layer structure of the structural material of the outer compartment and/or brewing container and/or outer sealing may comprise an outside polymer film, an intermediate barrier layer and an inside layer of polymer sealant. The outside polymer film may e.g. have a thickness in the range of 1 μm-80 μm, preferably 5 μm-50 μm. The intermediate barrier layer may e.g. have a thickness in the range of 1 μm-50 μm, preferably 2 μm-30 μm. The inside layer of polymer sealant may e.g. have a thickness in the range of 1 μm-400 μm, preferably 10 μm-200 μm.

In an embodiment of the invention, a preferred combination of materials for a multi-layer structure of the walls of the brewing container or of a separate outer sealing may comprise an outside polymer film, an intermediate barrier layer comprising a metal foil and an inside layer of polymer sealant (e.g. HDPE).

Likewise in an embodiment of the invention, a preferred combination of materials for a multi-layer structure, which forms the bottom material of the brewing container or of a separate outer sealing may comprise a similar multi-layer structure, wherein the intermediate metal foil barrier layer is substituted for a barrier layer comprising a polymer film being metallized and coated with e.g. EvOH (ethylene vinyl alcohol).

In an embodiment of the invention, differences in flexibility of the wall material and bottom material of the brewing container may be manipulated by substitutions, e.g. as described above, where the substitution of metal foil with a metallized film coated with EvOH may facilitate a more flexible multi-layer material.

If the film material comprises a multi-layer structure, the inner layer may comprise a so-called sealant facilitating the desired brewing device defining gatherings and/or that the film is weldable to other film materials.

The outer compartment and/or brewing container material and/or outer sealing may comprise one or more films or foils such as metal foils, polymer films, metallized or coated films, polymer sealants, polyesters, polyamides and polyolefines comprising polyethylenes and polypropylenes or any combination thereof.

In an embodiment of the invention, the wall material and bottom material of the outer compartment and/or brewing container and/or outer sealing may comprise a material having a multi-layer structure, and the combination of materials for the multi-layer structure may comprise an outside polymer film, an intermediate barrier layer and an inside layer of polymer sealant (e.g. HDPE).

The inner compartment and/or filter arrangement, the brewing container, and the outer sealing, may be formed as bags or pouches, may be assembled by weldings at the edges.

The heat resistance of the structural material of the brewing container and inner compartment and/or filter arrangement may preferably be up to at least 100° C. Thus, the materials, of which the brewing device is manufactured, may preferably be resistant to the temperature of boiling water.

Wall- and bottom material of the brewing container may preferably be forming a barrier for air, aroma, moisture, liquid, etc. The walls and bottom of the brewing container may preferably be liquid-impermeable.

The bottom material of the brewing device may in an embodiment of the invention preferably be more flexible than the wall material. The walls being relatively rigid may contribute to make the brewing device self-supporting, e.g. as a stand-up pouch, the material of the brewing container walls may have a rigidity, which is sufficient to allow the brewing container to be self-supporting. The bottom material being more flexible may contribute to make the brewing device easy to unfold from an initially 'packed' state.

A further type of material may also be applied for strengthening the brewing device, especially when applied as a self-supported, self-standing brewing device. Such material may e.g. include paper, cardboard, sheets of woven fibers, etc.

Generally, the materials of the brewing device may have a rigidity and heat stability adequate to secure stability during manufacture and handling of the brewing device.

Moreover, the brewing device may comprise an insulating wall structure at least partly surrounding the brewing container. Such a thermo structure may e.g. comprise air or gas-filled compartments.

The bottom material and wall material may preferably be adjusted according to each other in order to provide a brewing container, which may expand easily.

The polymer and/or metal sheets of the multilayer structure forming the brewing container may have a thickness in the range of 10 μm to 2 mm, preferably 40 μm to 500 μm, more preferably 60 μm to 200 μm and most preferably 80 μm to 150 μm.

In dependence of the material chosen the thickness may preferably be adjusted in order to obtain a rigidity, which allows the brewing container to be self-supporting.

The bottom of the brewing container may comprise a shape-sealed fold.

The bottom fold may contribute to enable the container to be self-supporting and hence no equipment is then needed to support the brewing device, as the container stands by itself. The shape of the weld of the bottom fold may significantly affect the shape of the brewing container when filled with liquid, which means that the brewing container during use may attain e.g. a circular-, oval-, or rectangular-like bottom form. Several other ways of obtaining a self-standing structure may be applied within the scope of the invention, such as multiple folds in the bottom of the device, etc.

In an embodiment of the invention the brewing container may comprise alternative bottom constructions also allowing the brewing container to attain standing abilities. The bottom construction may e.g. be non-folded.

The brewing container may in an embodiment comprise a translucent or at least semi-translucent liquid-impermeable material. The coating of an at least partly translucent brewing container may comprise ceramic materials such as aluminum oxides, zirconium oxides, glasses based on silicium oxide or other coating materials such as ethylene vinyl alcohol (EvOH) and combinations thereof. A translucent brewing container may be of convenience in use as it is possible to observe the brewing process. The storage capabilities i.e. shelf life of the brewing container before use may be reduced, as a translucent material is obviously not light-tight, but a sealing wrapped around the brewing container may solve this problem. Furthermore, the translucent or at least semi-translucent liquid-impermeable material may comprise an UV-filter.

The filter arrangement material and/or liquid-permeable inner compartment material may comprise punctured etched, melted, stamped or cut material. The material may e.g. comprise plast, polyolefines such as polyethylene or polypropylene, polyesters, polyamides and other polymers, woven or non-woven expanded plastic, cloth, screen, wire-mesh, metal or injection-molded plastic.

The inner compartment material and or filter material may comprise a film material.

The inner compartment material and or filter material may comprise a material, which is provided with holes, which have been created by stamping, cutting, etching or melting.

The liquid-permeability of the inner compartment and/or filter material may for example be obtained by a perforation of small holes. The liquid-permeable material, which is provided with holes, may e.g. be described as punctured with a certain density of holes per $cm^2$.

The density of holes may be in the range of 1-30 holes per $cm^2$, preferably 2-20 holes per $cm^2$ and most preferably 4-12 holes per $cm^2$.

The dimension of each hole may be in the range of 0.01 mm·0.01 mm to 2.00 mm·2.00 mm, preferably 0.1 mm·0.1 mm to 1.0 mm·1.0 mm, more preferably 0.1 mm·0.1 mm to 0.6 mm·0.6 mm In an embodiment of the invention, the preferred size of the hole is an elongated hole of the size 0.2 mm·0.4 mm.

Generally, the shape of the holes may vary from application to application.

The dimension of the holes may be adapted to provide a brewing time in the range of 1-10 minutes, preferably approximately 3-7 minutes under atmospheric pressure.

The inner compartment and/or filter arrangement may be made of a polymer material such as polypropylene, polyethylene, polyesters, polyamides, polyolefines, etc.

The material of the inner compartment and/or filter arrangement may preferably be welding compatible with a sealant of the brewing container material.

The brewing device may in an embodiment of the invention be formed of mutually welded film materials. The inside of the outer sealing or brewing container material may be weldable to the inner compartment material.

The inner compartment and/or filter arrangement may have a volume size in the range of 10 to 95% of the brewing container volume, preferably 50% to 90% of the brewing container volume.

The volume size of the inner compartment and/or filter arrangement may be established by different means such as the size of the inner compartment and/or filter material sheets, and in an embodiment of the invention by the positions of specific weldings in the inner compartment and/or filter material.

The volumes of the contact volume and target volume may be adjusted with respect to each other in order to create a space for interaction between liquid and aroma material. E.g. in coffee brewing, an infusion process may hereby be facilitated.

Generally, different shapes and localizations of the inner compartment and/or filter arrangement may be provided in order to adjust the flavor concentration and strength of the beverage. Thereby the design of the brewing device comprising inner and outer compartments may inherently contribute to the adjustment of a beverage. If the beverage for example is coffee, the design may influence the coffee to be mild, strong, etc.

In an embodiment of the invention, the contact and target volumes may be designed so that a large percentage of the contact volume, e.g. bounded by the filter arrangement, is not in contact with the walls or bottom of the brewing device. This may e.g. be obtained with an embodiment as shown in FIG. 20. Alternatively, the contact volume may actually be bounded by the walls and bottom of the brewing device as well as by the filter arrangement, which may e.g. be obtained with an embodiment as shown in FIG. 18.

In yet a further embodiment, the brewing device may comprise more than one contact volume and/or more than one target volume. In such case it may be preferred to provide the brewing device with more than one inner compartment and/or filter arrangement. The different compartments may be used for different aroma materials, which are to be mixed during brewing. Their separation in different compartments secures that they are not mixed before use.

The inner compartment and/or filter arrangement may comprise a bottom fold. An alternative suitable bottom construction may e.g. be a non-folded construction. According to the invention, the design of the folded or non-folded bottom of the inner compartment may affect the quality of the brewed beverage, for example by affecting the surface area of inner compartment and/or filter material.

The brewing container may comprise a top closing arrangement. The brewing container may thus be closed in the top by a peelable sealing. The peelable sealing may e.g. comprise polyethylene, a peelable coating or a peelable film formed by different techniques. The peelable sealing has the advantage of forming a barrier for gasses, aroma, moisture, etc. until it is broken.

The peelable sealing may comprise a filmstrip or a peelable strip of a hot melt type. A hot melt type peelable strip may be applied to at least one of the mutually facing surfaces, which are joined to a peelable sealing at the top of the brewing compartment or somewhere in a separate outer sealing. Likewise the peelable strip may be arranged either at the top or at another suitable location for a peelable sealing, which is to be broken by the user of the disposable brewing device of the present invention.

The closing arrangement may facilitate re-closing of the brewing container after liquid has been added. This closing may contribute to the isolation effect of the brewing container. The brewing container may form a kind of thermos package keeping the brewed beverage either warm or cold for a considerable period of time. The closing arrangement may further have the effect of preventing loss of beverage, for example if the brewing container accidentally falls. Moreover, the closing arrangement may contribute to protecting the user of the brewing container from getting into unwanted contact with the beverage being e.g. hot, sticky, colored, etc.

The closing arrangement may e.g. comprise a flap, a slide fastener, an adhesive material, etc., and combinations thereof. The closing arrangement may for example be a flap-solution comprising adhesive material or non-flap-solution comprising a slide fastener.

The brewing container may be equipped with a handle. The handle, which may attain different shapes and be mounted to the brewing container in different ways, may allow the user to lift, move and tilt the brewing container safely. Still with the objective of making the brewing container easy and safe to handle, it may be preferred to equip the brewing container with two or several handles.

The invention claimed is:

1. A disposable brewing device comprising:

at least one contact volume connectable with at least one target volume, said at least one contact volume and said at least one target volume being separated by at least one filter arrangement;

said at least one contact volume and said at least one target volume defining at least one predefined flow path through said filter arrangement, wherein said at least one contact volume is forming a part of a brewing container within said brewing device, and the brewing container is at least partly formed by joined sheets of liquid-impermeable material, and wherein said sheets of liquid-impermeable material comprises a wall and a bottom of said brewing container, and said liquid-impermeable bottom material is more flexible than said wall material.

2. A disposable brewing device according to claim 1, wherein said at least one target volume is forming a part of a brewing container within said brewing device.

3. A disposable brewing device according to claim 1, wherein at least a part of said contact volume and at least a part of said at least one target volume form a part of a brewing container within said brewing device.

4. A disposable brewing device according to claim 1, wherein said sheets of liquid-impermeable material comprises a heat-resistant polymer.

5. A disposable brewing device according to claim 1, wherein said sheets of liquid-impermeable material comprises a multi-layered sheets.

6. A disposable brewing device according to claim 1, wherein said sheets of liquid-impermeable material comprises a laminate of at least one polymer sheet and at least one metal sheet.

7. A disposable brewing device according to claim 1, wherein said bottom of the brewing container comprises a shape-sealed fold.

8. A disposable brewing device according to claim 1, wherein said sheets of liquid-impermeable material comprises at least one film or foil selected from the group consisting of metal foils, polymer films, metallized films, coated films, polymer sealants, polyesters, polyamides and polyolefines comprising polyethylenes and polypropylenes and any combination thereof.

9. A disposable brewing device according to claim 1, wherein the sheets of liquid-impermeable material of the brewing container have a rigidity, which is large enough to allow the brewing container to be self-standing.

10. A disposable brewing device according to claim 1, wherein said liquid-impermeable material of the brewing container has a thickness in the range of 10 μm to 2 mm.

11. A disposable brewing device according to claim 1, wherein the brewing container is at least partly formed by welded sheets.

12. A disposable brewing device according to claim 1, wherein said brewing container has a liquid volume of approximately 0.1 liters to 25 liters.

13. A disposable brewing device according to claim 1, wherein said multi-layer structure of the brewing container material comprises an outside polymer film, an intermediate barrier layer and an inside layer of polymer sealant.

14. A disposable brewing device according to any of the claim 1, wherein said contact volume is at least partly formed by said at least one filter arrangement.

15. A disposable brewing device according to claim 1, wherein said contact volume comprises at least one filter arrangement suspended in the brewing container.

16. A disposable brewing device according to claim 1, wherein said filter arrangement comprises a heat-resistant sheet material and wherein at least a part of said heat-resistant sheet material comprises liquid permeable material.

17. A disposable brewing device according to claim 16, wherein said heat-resistant sheet material comprises a heat-resistant polymer.

18. A disposable brewing device according to claim 16, wherein said liquid-permeable material comprises a heat-resistant polymer sheet formed with a pattern of holes.

19. A disposable brewing device according to claim 16, wherein the liquid-permeable material is provided with a density of holes in the range of 1-30 holes per $cm^2$, wherein said holes have dimensions in the range of 0.01 mm to 2.00 mm, wherein the dimension of said holes is adapted to provide a brewing time of approximately 3-12 minutes under atmospheric pressure.

20. A disposable brewing device according to claim 16, wherein the liquid-permeable material of the filter arrangement is provided with holes, which have been created by stamping, cutting, etching or melting.

21. A disposable brewing device according to claim 1, wherein the filter arrangement is made of a material comprising polypropylene, polyethylene, polyesters, polyamides or polyolefines or other polymers.

22. A disposable brewing device according to claim 1, wherein said contact volume comprises a pouch.

23. A disposable brewing device according to claim 1, wherein a volume of the contact volume is regulated by a position of at least one welding in the filter arrangement.

24. A disposable brewing device according to claim 1, wherein the brewing container and the contact volume are mutually fastened by welding.

25. A disposable brewing device according to claim 1, wherein said contact volume comprises a bottom fold.

26. A disposable brewing device according to claim 1, said brewing device comprising at least one liquid inlet to said contact volume.

27. A disposable brewing device according to claim 1, said brewing device comprising a liquid outlet arrangement from said contact volume.

28. A disposable brewing device according to claim 1, said brewing device comprising a liquid outlet arrangement from said target volume.

29. A disposable brewing device according to claim 28, said outlet arrangement comprises a predefined outlet opening.

30. A disposable brewing device according to claim 28, said outlet arrangement comprises a removable, a cuttable, or a breakable part of the device or any combination thereof.

31. A disposable brewing device according to claim 1, said brewing container comprises a closing arrangement.

32. A disposable brewing device according to claim 31, wherein said closing arrangement comprises a top flap, a slide fastener, an adhesive material or combinations thereof.

33. A disposable brewing device according to claim 31, said closing arrangement being closable when said brewing container contains liquid.

34. A disposable brewing device according to claim 31, wherein said closing arrangement comprises a peelable sealing.

35. A disposable brewing device according to claim 31, wherein said closing arrangement comprises a film strip or a peelable strip of a hot melt type.

36. A disposable brewing device according to claim 1, wherein said contact volume comprises aroma material.

37. A disposable brewing device according to claim 36, wherein said aroma material comprises roast and/or ground coffee, instant coffee, tea, milk powder, herb, fruit, meat, chocolate powder, vegetables, grains, alcohol gels, encapsulated alcohol or any combination thereof or any other materials which comprises or provides flavor or aroma or other functionalities.

38. A disposable brewing device according to claim 1, wherein said contact volume comprises further additives.

39. A disposable brewing device according to claim 1, said contact volume comprises an inner compartment which is at least partly formed by a liquid-permeable material, wherein said target volume comprises at least one outer compartment, said at least one outer compartment forming a brewing container, said brewing container being formed by a liquid-impermeable material, said at least one liquid-permeable inner compartment being integrated within said brewing container.

40. A disposable brewing device according to claim 1, wherein said brewing device is provided with at least one outlet duct from the target volume an output arrangement.

41. A disposable brewing device according to claim 1, wherein said brewing device comprises a substantially air-, aroma-, and liquid-impermeable outer sealing.

42. A disposable brewing device according to claim 41, wherein said outer sealing is forming an encapsulation of aroma material prior to use.

43. A disposable brewing device according to claim 41, wherein said outer sealing is forming an encapsulation of aroma material contained in the contact volume prior to use.

44. A disposable brewing device according to claim 41, wherein said brewing container forms the outer sealing of the brewing device.

45. A disposable brewing device according to claim 39, wherein said inner compartment comprises aroma material and is sealed by said outer compartment.

46. A disposable brewing device according to claim 41, wherein the brewing container and the inner compartment and the outer sealing are formed from sheets, webs, rolls or lengths of structural material.

47. A disposable brewing device according to claim 41, wherein said outer sealing comprises at least one polymer film, metallized or coated film, EvOH-coating, metal foil, sealant or combinations thereof.

48. A disposable brewing device according to claim 1, wherein heat resistance of structural material of the brewing container and inner compartment material is up to at least 100° C.

49. A disposable brewing device according to claim 1, wherein said brewing container is equipped with at least one handle.

50. A disposable brewing device according to claim 1, wherein said brewing container forms at least a part of a fixation and support for the contact volume.

51. A disposable brewing device according to claim 1, further comprising translucent or at least semi-translucent liquid-impermeable material having an UV-filter.

52. Method of brewing liquid in a disposable brewing device according to claim 1, said method comprising:

establishing a flow of hot liquid from at least one contact volume of the brewing device to at least one target volume, said at least one contact volume and said at least one target volume being separated by at least one filter arrangement, said at least one contact volume and said at least one target volume defining at least one predefined flow path through said filter arrangement, said at least one contact volume forming a part of a brewing container.

53. Method of brewing liquid according to claim 52, wherein said at least one target volume forms part of the brewing container.

54. Method of brewing liquid according to claim 52, wherein said at least one predefined flow path is established within the brewing device when hot liquid is poured into the brewing device.

55. Method of brewing liquid according to claim 52, wherein said at least one predefined flow path is established when hot liquid is discharged from the brewing device.

56. Method of brewing liquid according to claim 52, wherein the Method of brewing liquid is performed in a disposable device according to claim 1.

57. Method of brewing liquid according to claim 52, whereby the brewing is performed in said brewing container under substantially atmospheric pressure.

58. Method of brewing liquid according to claim 52, whereby said brewed liquid comprises coffee obtained by adding hot water into said brewing container under substantially atmospheric pressure.

* * * * *